US011019936B2

(12) United States Patent
Fisher

(10) Patent No.: US 11,019,936 B2
(45) Date of Patent: Jun. 1, 2021

(54) POCKETED FOAM SYSTEMS AND METHODS

(71) Applicant: ZEPLUS, LLC, Franklin, OH (US)

(72) Inventor: Herman Franklin Fisher, Franklin, OH (US)

(73) Assignee: Zeplus, LLC, Franklin, OH (US)

( * ) Notice: Subject to any disclaimer, the term of this patent is extended or adjusted under 35 U.S.C. 154(b) by 0 days.

(21) Appl. No.: 16/438,317

(22) Filed: Jun. 11, 2019

(65) Prior Publication Data

US 2019/0290015 A1 Sep. 26, 2019

Related U.S. Application Data

(63) Continuation of application No. 15/188,587, filed on Jun. 21, 2016, now Pat. No. 10,357,116.

(60) Provisional application No. 62/204,148, filed on Aug. 12, 2015, provisional application No. 62/187,649, filed on Jul. 1, 2015, provisional application No. 62/182,921, filed on Jun. 22, 2015.

(51) Int. Cl.

| | |
|---|---|
| ***A47C 27/10*** | (2006.01) |
| ***A47C 27/15*** | (2006.01) |
| ***A47C 21/04*** | (2006.01) |
| ***A47C 27/05*** | (2006.01) |
| ***A47C 27/06*** | (2006.01) |
| ***A47C 7/18*** | (2006.01) |
| ***A47C 27/20*** | (2006.01) |
| ***A47C 31/10*** | (2006.01) |
| ***A47G 9/02*** | (2006.01) |

(52) U.S. Cl.

CPC ..... *A47C 27/15* (2013.01); *A47C 7/18* (2013.01); *A47C 21/046* (2013.01); *A47C 27/056* (2013.01); *A47C 27/064* (2013.01); *A47C 27/20* (2013.01); *A47C 31/105* (2013.01); *A47G 9/02* (2013.01)

(58) Field of Classification Search

CPC ... A47C 27/008; A47C 27/063; A47C 27/064; A47C 27/07; A47C 27/045; A47C 27/0456; B68G 9/00

See application file for complete search history.

(56) References Cited

U.S. PATENT DOCUMENTS 685,160 A * 10/1901 Marshall ..... A47C 27/064 5/720
975,695 A * 11/1910 Knuppen ..... A47C 27/064 5/655.8
1,218,314 A * 3/1917 Read ..... B68G 9/00 53/114
1,260,672 A * 3/1918 Hunt ..... A47C 27/064 5/655.8
1,287,591 A * 12/1918 Meutsch ..... A47C 27/064 5/720

(Continued)

*Primary Examiner* — Peter M. Cuomo
*Assistant Examiner* — Ifeolu A Adeboyejo
(74) *Attorney, Agent, or Firm* — Ulmer & Berne LLP

(57) ABSTRACT

Example embodiments include a padding system that can include a first pocket assembly, the first pocket assembly including a first pocket, where the first pocket at least partially retains a first padding component, and a second pocket assembly, the second pocket assembly including a second pocket, where the second pocket at least partially retains a second padding component, where the first pocket assembly is coupled to the second pocket assembly with a transition portion.

20 Claims, 18 Drawing Sheets

(56) References Cited

U.S. PATENT DOCUMENTS 1,406,051 A * 2/1922 Marcus ..... A47C 27/04 5/655.8
1,531,547 A * 3/1925 Edelson ..... A47C 27/07 5/719
1,544,415 A * 6/1925 Suekoff ..... A47C 27/04 5/655.8
1,544,416 A * 6/1925 Suekoff ..... A47C 27/04 29/91.1
1,560,588 A * 11/1925 Lewis ..... A47C 27/04 5/655.8
1,671,363 A * 5/1928 Gail ..... A47C 27/04 5/720
1,773,925 A * 8/1930 Meutsch ..... A47C 27/05 5/655.8
1,906,159 A * 4/1933 Krakauer ..... A47C 27/04 5/655.8
2,236,007 A * 3/1941 Oldham ..... A47C 27/04 267/93
3,031,690 A * 5/1962 Ramsay ..... A47C 23/002 5/401
3,083,381 A * 4/1963 Bailey ..... A47C 27/081 219/217
6,021,627 A * 2/2000 Mossbeck ..... B65B 63/02 29/896.92
6,122,900 A * 9/2000 Mossbeck ..... B65B 63/02 29/896.92
6,143,122 A * 11/2000 Mossbeck ..... A47C 27/064 156/291
6,170,807 B1 * 1/2001 Eto ..... A47C 27/062 267/103
6,176,961 B1 * 1/2001 Mossbeck ..... A47C 27/064 156/291
6,347,423 B1 * 2/2002 Stumpf ..... A47C 27/053 5/655.9
6,408,514 B1 * 6/2002 Mossbeck ..... B21F 33/04 140/3 CA
7,082,635 B2 * 8/2006 Barman ..... A47C 27/053 5/717
7,841,031 B2 * 11/2010 Rawls-Meehan ..... A47C 7/027 5/719
8,181,296 B2 * 5/2012 Rawls-Meehan ..... A47C 7/027 5/722
9,510,690 B2 * 12/2016 Rawls-Meehan ..... A47C 7/14
2007/0204407 A1 * 9/2007 Lee ..... A47C 27/04 5/720
2010/0319137 A1 * 12/2010 Witherell ..... A47C 27/04 5/717
2015/0210498 A1 * 7/2015 Clare ..... B65B 63/02 100/40
2016/0045034 A1 * 2/2016 Hager ..... A47C 27/064 5/720
2017/0008064 A1 * 1/2017 Clare ..... B21F 3/02

* cited by examiner

POCKETED FOAM SYSTEMS AND METHODS

CROSS-REFERENCE TO RELATED APPLICATIONS

The present application is a continuation of U.S. Non-Provisional application Ser. No. 15/188,587, filed Jun. 21, 2016 which claims priority to U.S. Provisional Patent Application Ser. No. 62/204,148, filed Aug. 12, 2015, to U.S. Provisional Patent Application Ser. No. 62/187,649, filed Jul. 1, 2015, and to U.S. Provisional Patent Application Ser. No. 62/182,921, filed Jun. 22, 2015, and hereby incorporates the same applications herein by reference in their entirety.

TECHNICAL FIELD

Embodiments of the technology relate, in general, to bedding, mattress, and furniture padding, and in particular to bedding, mattresses, and furniture incorporating pocketed foam systems and methods.

BACKGROUND

A mattress is a large pad for supporting the reclining body, used as a bed or as part of a bed. Mattresses may consist of a quilted or similarly fastened case, usually of heavy cloth, that contains hair, straw, cotton, foam rubber, etc., or a framework of metal springs. Mattresses may also be filled with air or water.

Mattresses are usually placed on top of a bed base which may be solid, as in the case of a platform bed, or elastic, e.g. with an upholstered wood and wire box spring or a slatted foundation. Mattresses may be supplied with a secondary mattress and/or a removable "topper." A mattress may include an innerspring core and cotton batting or fiberfill. Modern mattresses usually contain either an inner spring core or materials such as latex, viscoelastic or other flexible polyurethane foams. Other fill components include insulator pads over the coils that prevent the bed's upholstery layers from cupping down into the innerspring, as well as polyester fiberfill in the bed's top upholstery layers. In 1899 James Marshall introduced the first individually wrapped pocketed spring coil mattress now commonly known as Marshall coils. Mattresses may also be filled with air or water, or a variety of natural fibers, such as in futons.

BRIEF DESCRIPTION OF THE DRAWINGS

The present disclosure will be more readily understood from a detailed description of some example embodiments taken in conjunction with the following figures.

DETAILED DESCRIPTION

Figure 1:
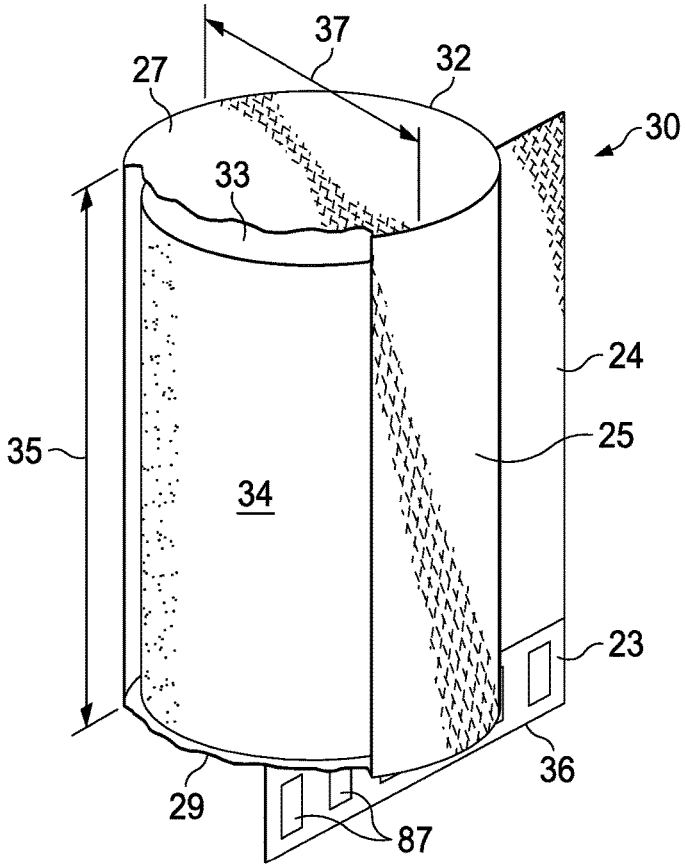
FIG. 1 is a front perspective view of a padding pocket, according to one embodiment, shown with a portion of the pocket partially removed to display a padding component retained therein.
Figure 2:
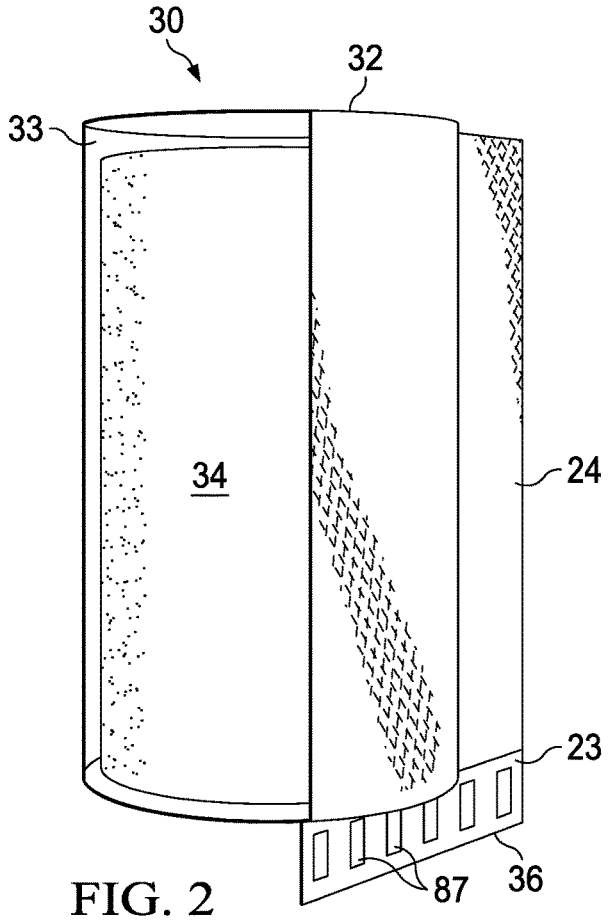
FIG. 2 is an alternate front perspective view of the padding pocket of FIG. 1.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment,"

"some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment", or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, systems, and methods for bedding, mattress, padding, cushion, seating, reclining, and furniture applications. In one example embodiment, one or a plurality of pockets can retain a plurality of foam components to form a padding system or assembly. In some embodiments, each pocket can partially, substantially, or wholly retain a foam or padding component. In some embodiments, each pocket can contain a plurality of foam components having the same or different shapes, sizes, and materials. In some embodiment, each pocket can contain a combination of foam components, springs, innersprings, coils, padding, support material, cushion material, absorbent material, elastic material, memory retention material, combinations thereof, or the like.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Referring now to FIG. 1, an example of a pocket assembly 30 is shown having a pocket 32, a padding component 34, and a transition portion or weld seam 36. A plurality of pocket assemblies 30 can be joined or otherwise formed to provide cushioning in the form of a mattress, topper, bedding, or the like. The padding component 34 can be wholly or partially encapsulated by the pocket 32 in a cavity 33 defined by the pocket 32, where the pocket 32 material can be porous and permeable to airflow which can permit high breathability. In one embodiment, the pocket 32 can be made from general woven or non-woven fabrics, which can include polypropylene and polyester. The padding component 34 can be encapsulated with a non-woven material that does not restrict the padding component 34 in response to a load, where the padding component 34 can return to full height once the load is uncompressed. Embodiments of a woven or non-woven pocket 32 can be comprised of different types of base fabrics which include polypropylene, cotton, nylon, lycra, UBL, and/or polyester. In an alternate embodiment, the pocket 32 can substantially seal the padding component 34 in an airtight or watertight configuration such that the cavity 33 can be filled with a pressurized gas or other desirable material or fluid.

The pocket 32 can have a generally cylindrical configuration having a height 35 and a width 37. It will be appreciated that the pocket 32 can have any suitable configuration with any suitable height as will be described in more detail herein. The pocket can include a circumferential portion 25, an upper portion 27, and a lower portion 29. The circumferential portion 25, upper portion 27, and lower portion 29 can cooperate to define the cavity 33. The upper portion 27 and lower portion 29 can be substantially collinear and can have substantially identical configurations. In one embodiment, the upper portion 27 and lower portion 29 are formed from the same sheet of material and, in an alternate embodiment, the portions 27 and 29 are formed separately and are fused, sewn, or otherwise coupled to shape the pocket 32. In the illustrated embodiment the width 37 is the same as the diameter of the pocket 32, but it will be appreciated that other geometries such as a cube are contemplated that can add the dimension of depth to the height and width. Any suitable depth is contemplated in such embodiments. Although a circumferential portion 25 may be a single piece of material in the illustrated embodiment it will be appreciated that other embodiments, such as cube-shaped embodiments, may have a plurality of panels comprising the perimeter of the pocket. In some embodiments, such as those useful for a mattress core or supportive layer, the height 35 can be greater than the width 37 of the pocket 32. In such applications a height to width ratio of 2:1 or 3:1 is contemplated. In alternate embodiments, such as those associated with a topper, the width 37 may be greater than the height 35 of the pocket. In such applications a width to height ration of 2:1 or 3:1 is contemplated. The height 35 may be from about 0.5 inches to about 8 inches, from about 1 inch to about 10 inches, from about 2 inches to about 6 inches, from about 2.5 inches to about 4.5 inches, or any other suitable height. The width 37 may be from about 1 inch to about 4 inches, from about 2 inches to about 3 inches, from about 0.5 inches to about 5 inches, or any suitable width.

Figure 3:
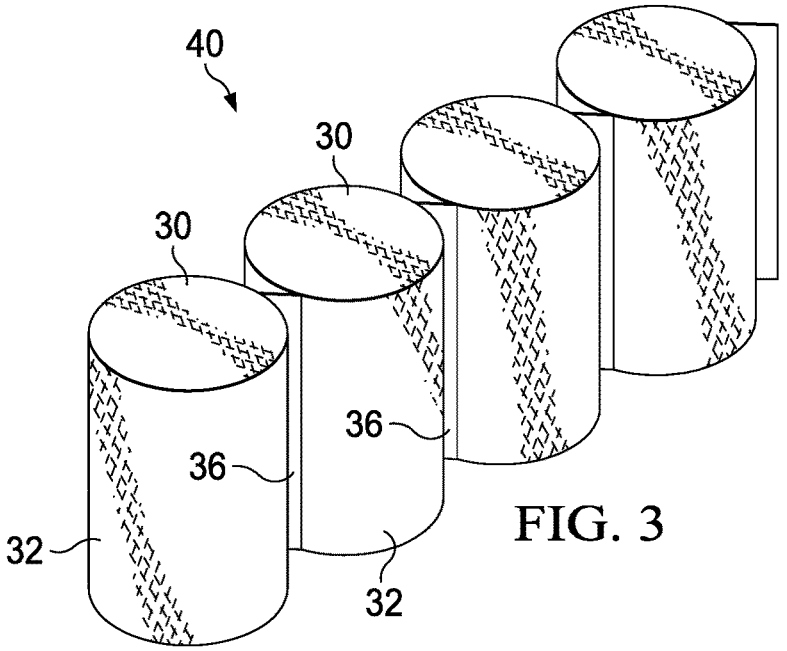
FIG. 3 is a front perspective view of a pocket string, having a plurality of padding pockets joined together, according to one embodiment.

The transition portion or weld 36 associated with the pocket assembly 30 can have a first portion 23 and a second portion 24 in one embodiment. The first portion 23 can be associated with the bottom portion 29 of the pocket 32 and can be integrally formed or attached to the bottom portion 29. The first portion 23 of the weld 36 can be configured for attachment to a substrate or bottom layer of material as described in more detail herein (See FIG. 11 or 20 for example). The first portion 23 can define a plurality of apertures 87 that can function as attachment points to a substrate layer of a mattress, topper, or the like. Any suitable fastener, weld, adhesive, or the like can be used to couple the pockets with any suitable layer of material. It will be appreciated that the first portion 23 is provided by way of example only, where embodiments may exclude the first portion 23. The weld 36 can further include the second portion 24 that can comprise a lateral flap sized for attachment to an adjacent pocket 32. The second portion 24 of the weld can facilitate the coupling of multiple pocket assemblies 30 into a string 40 (FIG. 3). It will be appreciated that the weld 36 can have any suitable features suitable for attaching one or a plurality of pocket assemblies to other pocket assemblies or to a substrate material. It will be appreciated that embodiments without a weld are contemplated where any attachment to another pocket assembly or substrate is contemplated.

The pocket assembly 30 can have a substantially cylindrical shape that can accept a substantially cylindrically shaped padding component 34 within a substantially cylindrically shaped pocket 32. It will be appreciated that the pocket assembly 30 can have any suitable shape and can be configured to accept any suitably shaped components, such as padding components, for example. In one embodiment, using a plurality of padding pockets, such as pocket assemblies 30, can reduce the weight of a standard foam core. For example, the padding component 34 can be foam, where less foam may be needed for a comparable level of comfort throughout the mattress, topper, or the like. In one configuration, a plurality of pocket assemblies 30 can align directly with compression loads uniformly and can utilize pocket spacing that requires less overall foam. The pocket assembly 30 can reduce heat where, for example, each pocket assembly 30 can include spacing in the cavity 33 such that air can circulate. It will be appreciated that any suitable spacing can be provided within the cavity 33 of the pocket 32 to facilitate airflow, movement of the padding component 34, or for any other suitable reason. Alternatively, the cavity 33 may be substantially filled with the padding component 34 such that additional space within the cavity 33 is minimized.

Figure 4:
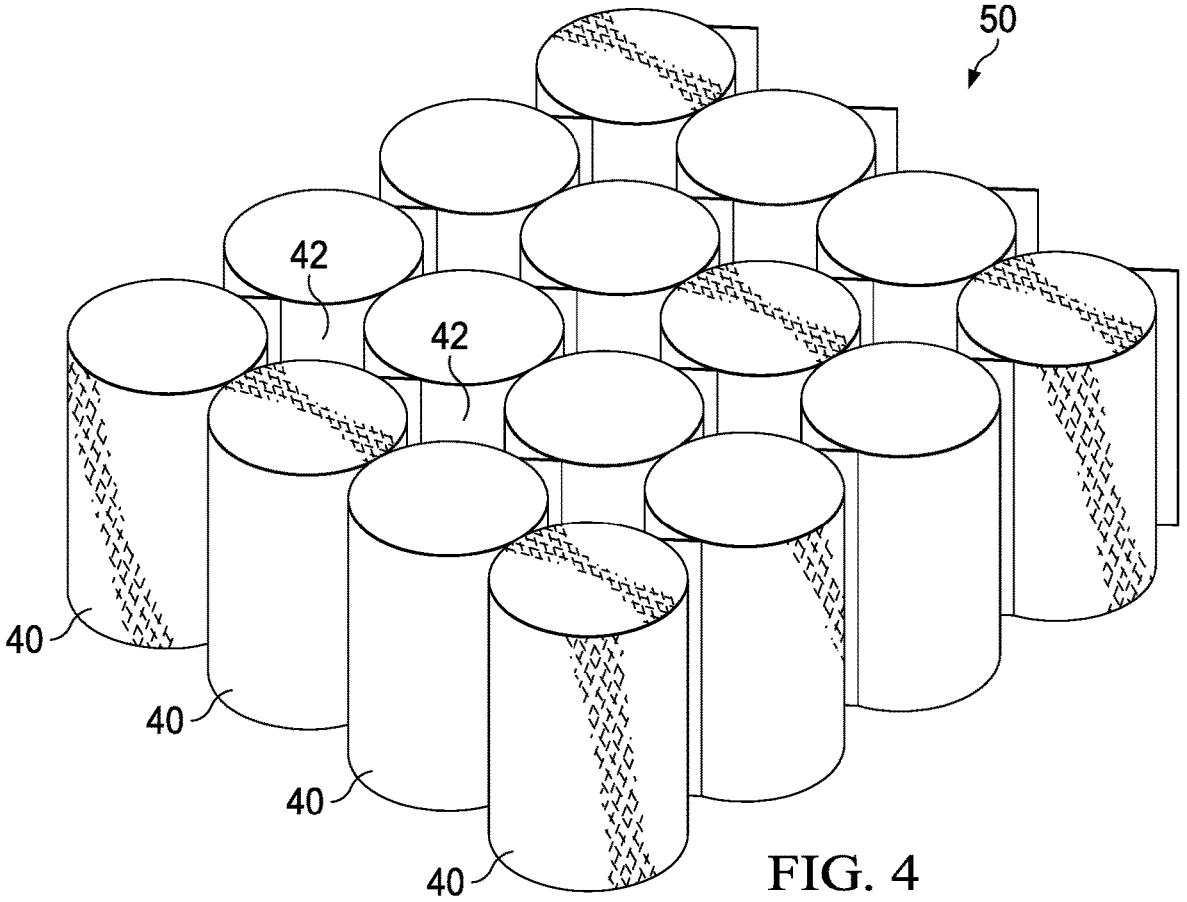
FIG. 4 is a front perspective view of a plurality of pocket strings, such as those shown in FIG. 3, joined together to form a pocket system according to one embodiment.

Referring to FIG. 3, a plurality of pocket assemblies 30 can be connected in a string 40 arrangement where welded seams 36 can substantially divide the pocket assemblies 30. Any suitable number of pocket assemblies 30 can be provided in a string 40 arrangement depending upon the needs of a particular use or application. Referring to FIG. 4, a plurality of strings 40 can be joined, coupled, or positioned proximately to form a sheet 50 having a plurality of pocket assemblies 30 positioned within the same plane of orientation. Although the strings 40 are shown having a generally vertical orientation it will be appreciated that a horizontal orientation is contemplated. The strings 40 can be fused, can be detachably coupled, or can be retained in close proximity with a covering (now shown) that partially or fully encapsulates the sheet 50. Some embodiments of the sheet 50 can include the elimination of coil springs, which may create undesirable noise. Undesirable noise associated with bedding generally occurs when pressure collapses the bedding and the coil returns and edges the fabric, the coil, or other coils. A padding component 34, such as a foam component within a pocket 32, may reduce the noise commonly associated with coil spring systems. Undesirable noise may be reduced where foam abrasion against the pocket 32 may be uniform in accordance with versions described herein. However, the sheet 50 may still retain the desirable features of a coil with high resilience or the use of slow return foam once the pocket is collapsed to promote a return to the original height. Foam components may also reduce the risk of defects to bedding in comparison to a coil spring, where a coil may be more likely to penetrate the fabric.

The padding components 34 of the sheet 50 can be comprised of the same or different materials, which can include a continuous matrix of individual foam pockets to form a pocket foam mattress core containing polyurethane foam, polyethylene foam, polyether foam, viscoelastic memory foam, polyester fibers, gel foam, latex foam, or other chemistry based technologies. The padding component 34 can include a viscoelastic material that can also give the slow rate of return that is often desirable for the specialty bedding market. In another embodiment, the padding component 34 in a pocket foam mattress core can help distribute the load evenly. The padding components 34 of the sheet 50 can be characterized by the diameter of the padding component 34 from, for example, from about 0.5 inches to about 8 inches. A padding component 34 can be characterized by the height of the padding component and can range from about 0.5 inches to about 10 inches, for example. Systems described herein can be used in topper or overlayer configurations for use with existing mattresses, bedding, furniture, or the like. Topper configurations can incorporate padding components 34 from about 0.5 inches to about 4 inches, for example. It will be appreciated that any sizing of the padding components 34 is contemplated.

Embodiments can include a sheet 50 or matrix of individual pocket assemblies 30 with any suitable pocket 32 length, width, and shape. The padding components 34 can similarly be any suitable shape and can correspond to the pocket 32 shape and size. Examples of padding component 34 shapes can include cylinder, hour glass, barrel, square, triangle, square, pentagon, hexagon, heptagon, octagon, nonagon, decagon, cube, cuboid, sphere, cone, hexagonal prism, pyramid base, and/or dissimilar geometries. It will be appreciated that the sheet 50 can include homogenous or dissimilar pocket assemblies 30. It will be appreciated that the pocket assemblies 30 can be arranged to create any suitable shape for the sheet 50 such as a rectangle, square, cylinder, or the like.

Figure 5:
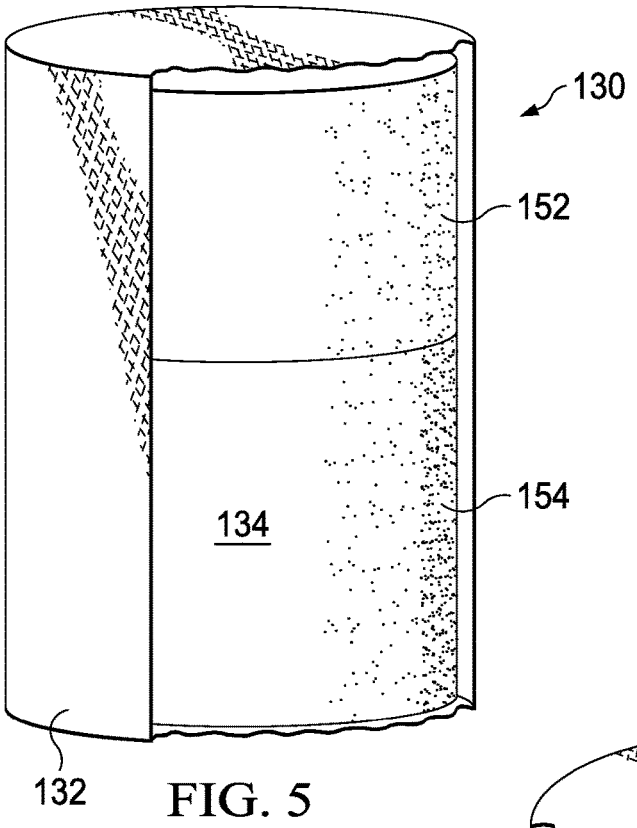
FIG. 5 is a front perspective view of a padding pocket shown with the pocket partially removed to display a first foam component and a second foam component according to one embodiment.

Referring to FIG. 5, one embodiment of a pocket assembly 130 is shown having a pocket 132 and a padding component 134, wherein the padding component 134 includes a first section 152 and a second section 154. It may be beneficial to provide a padding component 134 constructed from different materials to create a different feel, provide different levels of support, provide added variety in customer selectable options, or the like. In one embodiment, the first section 152 can be constructed from a first material and the second section 154 can be constructed from a second material. The sections 152, 154 can be co-molded, fused together, or can be unattached to one another but held in position by the pocket 132. Embodiments can include sections 152, 154 made from polyurethane foam, polyethylene foam, polyether foam, viscoelastic memory foam, polyester fibers, gel foam, latex foam, and/or other chemistry based technologies.

Although in one embodiment the sections 152 and 154 can be distinct components it will be appreciated that the padding component 134 can be a dual density foam component. Foam density can be defined by the weight of the foam divided by the volume expressed in pounds per cubic foot, where dual density foam components can be used in an individual padding component 134. The padding component 134 can be characterized by the density of the foam in the range from about 0.01 pounds to about 15 pounds per cubic foot. A single padding component 134 can include a dual density of two different types of foams by density or type. In a dual composition, the first section 152 can have a density of 2 pounds per cubic foot and the second section can have a density of 4 pounds per cubic foot. The sections 152 and 154 can be the same type of material with different densities, or can be different materials, such as foams like a urethane and visco foam, having different densities. In one embodiment, the second section 154 has a greater density than the first section 152, where greater density in the lower section may add support and lower density in the upper section may provide improved comfort. The first section 152 can have a density from about 0.5 to about 4 pounds per cubic foot, from about 1 to about 3 pounds per cubic foot, from about 2 to about 5 pounds per cubic foot, or any other suitable density. The second section 154 can have a density from about 1 to about 7 pounds per cubic foot, from about 2 pounds to about 6 pounds per cubic foot, from about 3 pounds to about 5 pounds per cubic foot, or any other suitable density.

Figure 6:
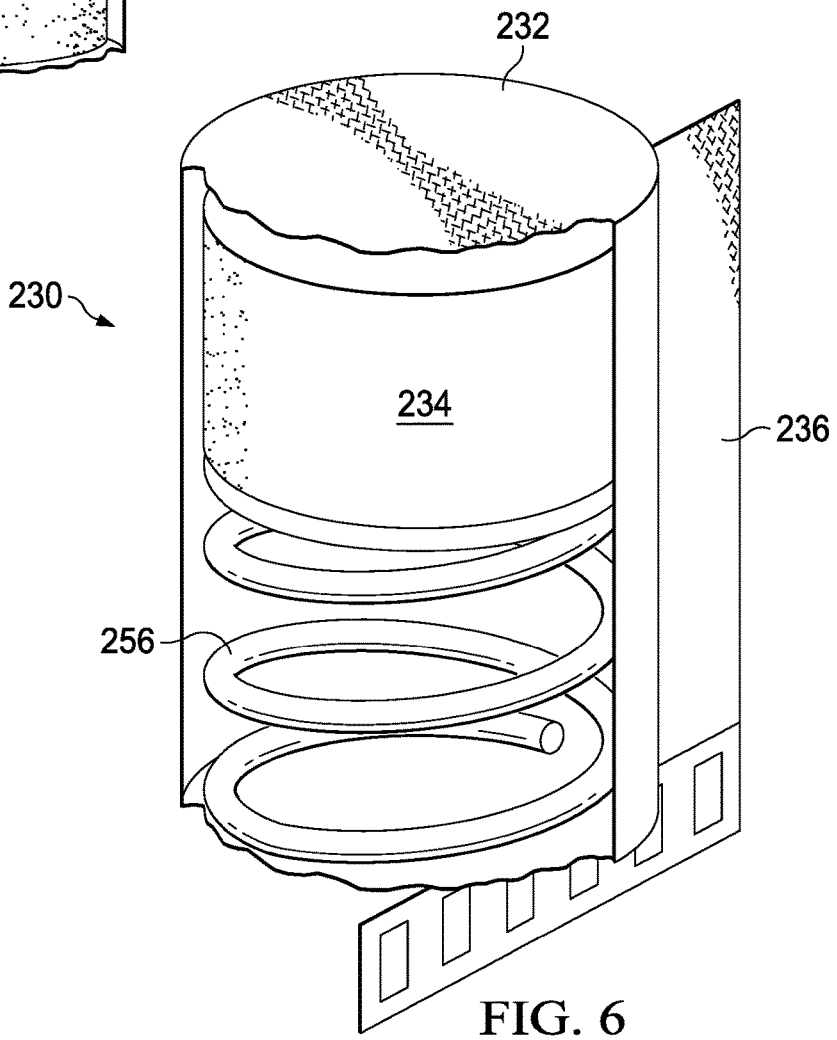
FIG. 6 is a front perspective view of a padding pocket shown with the padding pocket partially removed to display a foam component and an innerspring coil according to one embodiment.

Referring to FIG. 6, an alternate embodiment of a pocket assembly 230 is shown having a pocket 232, a padding component 234, and an innerspring coil 256. It may be advantageous to provide a pocket assembly 230 that includes features of a foam-based system with the benefits of a coil-based system. In one embodiment, a foam component hybrid for a pocket assembly 230 can have a foam component or padding component 234 associated with an innerspring coil 256 in a single pocket 232. Multiple pockets can be connected to form an array string of hybrid pocket assemblies 230 in accordance with versions described herein. Any suitable relationship between the padding component 234 and coil 256 is contemplated, where as shown in FIG. 6 the padding component 234 may be positioned substantially above the coil 256 such that the user can experience the comfort of the padding component 234.

A system including a plurality of padding pockets containing coils may make less noise than a traditional mattress as the pocketed cells may buffer the noise made by springs during use. This reduction of noise can further be accomplished through the removal of coils altogether and replacing the coils with foam in pockets. The foam may have a soft touch that is not abrasive to the fabric which may further reduce noise. Coil springs may also create defects when the coil snags the fabric as the coil returns to its original height. Foam components may not snag fabric due to the non-abrasive surface. Coils retained within pockets may cause fewer defects to the padding, generally, as the pocket can be lined to prevent snaps, puncture, or the like.

Figure 7:
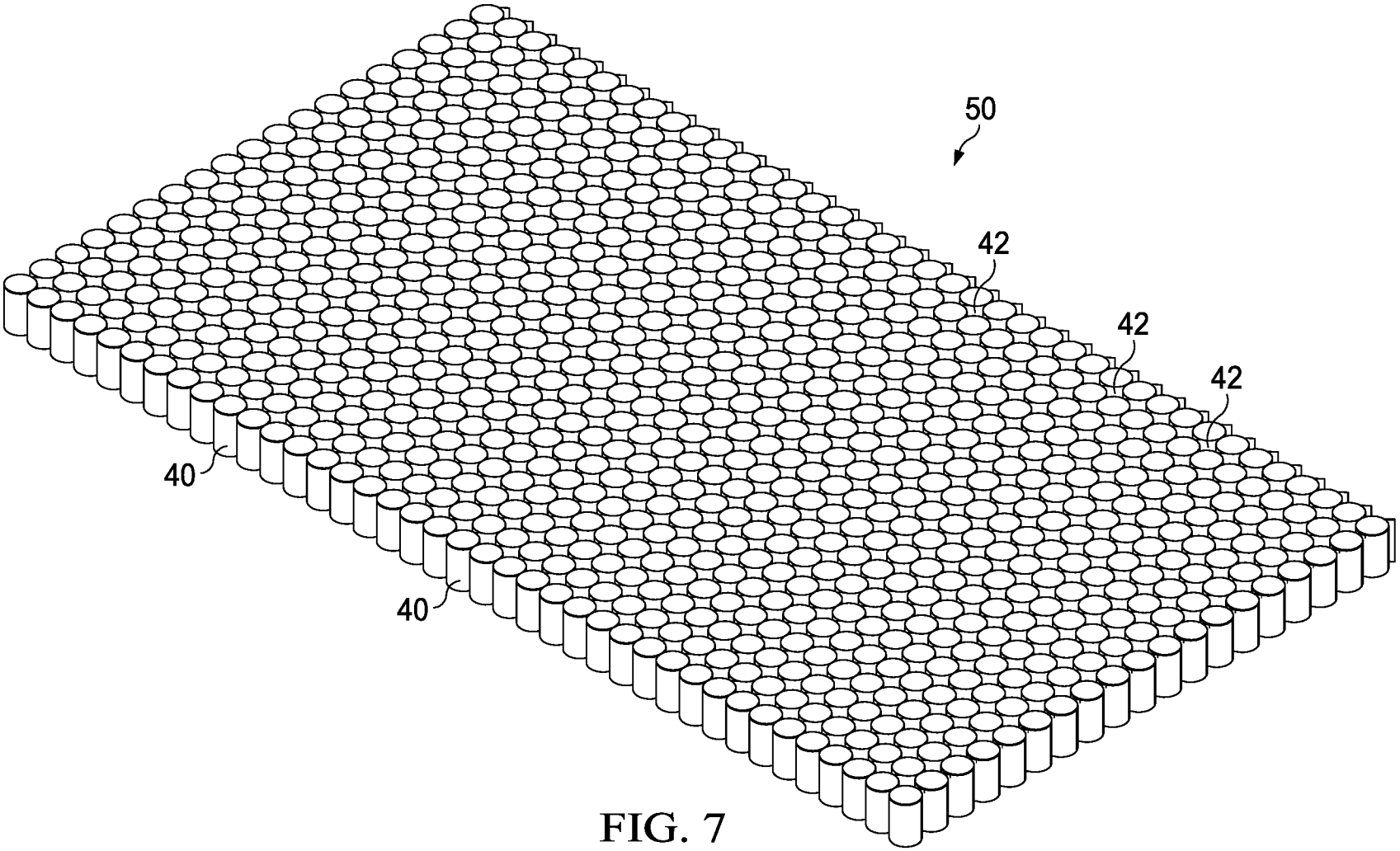
FIG. 7 is a top perspective view of a system of a sheet of attached padding pockets according to one embodiment.

FIG. 7 illustrates one embodiment of a sheet 50 having a substantially rectangular configuration with sixteen strings 40 and three hundred and eighty-four total pocket assemblies 30. It will be appreciated that the total number of pocket assemblies 30 can range from about 2 to about 1000, from about 50 to about 500, from about 200 to about 800, from about 300 to about 500, or any other suitable number. It will be appreciated that the number of strings 40 can range from about 1 to about 50, from about 10 to about 20, from about 15 to about 30, or any other suitable number. It will be appreciated that different size of beds, such as king, queen, full, and twin beds, may have different numbers of associated pocket assemblies. It will be appreciated that the inclusion of foam rails (see, for example, FIG. 21) or other features may diminish the number of pocket assemblies in a particular mattress, topper, or sheet 50. The sheet 50 can include a plurality of air gaps 42 that can be apertures or spaces defined by the pocket assemblies 30. The air gaps 42 can allow for air circulation through the sheet 50 that may reduce heat and increase comfort for a user. The air gaps 42 can extend through the entire sheet 50 or, as shown in alternate embodiments, may only extend partially into the sheet 50. The shape of the air gaps 42 can be defined by the outer surface of the pocket assemblies 30, where it is also contemplated that additional fabric or material can be added to the sheet 50 to modify or shape the air gaps 42 into a desirable configuration. Certain embodiments of the sheet 50 can incorporate fans, heaters, and/or cooling elements (not shown) to circulate air through the air gaps 42.

Figure 8:
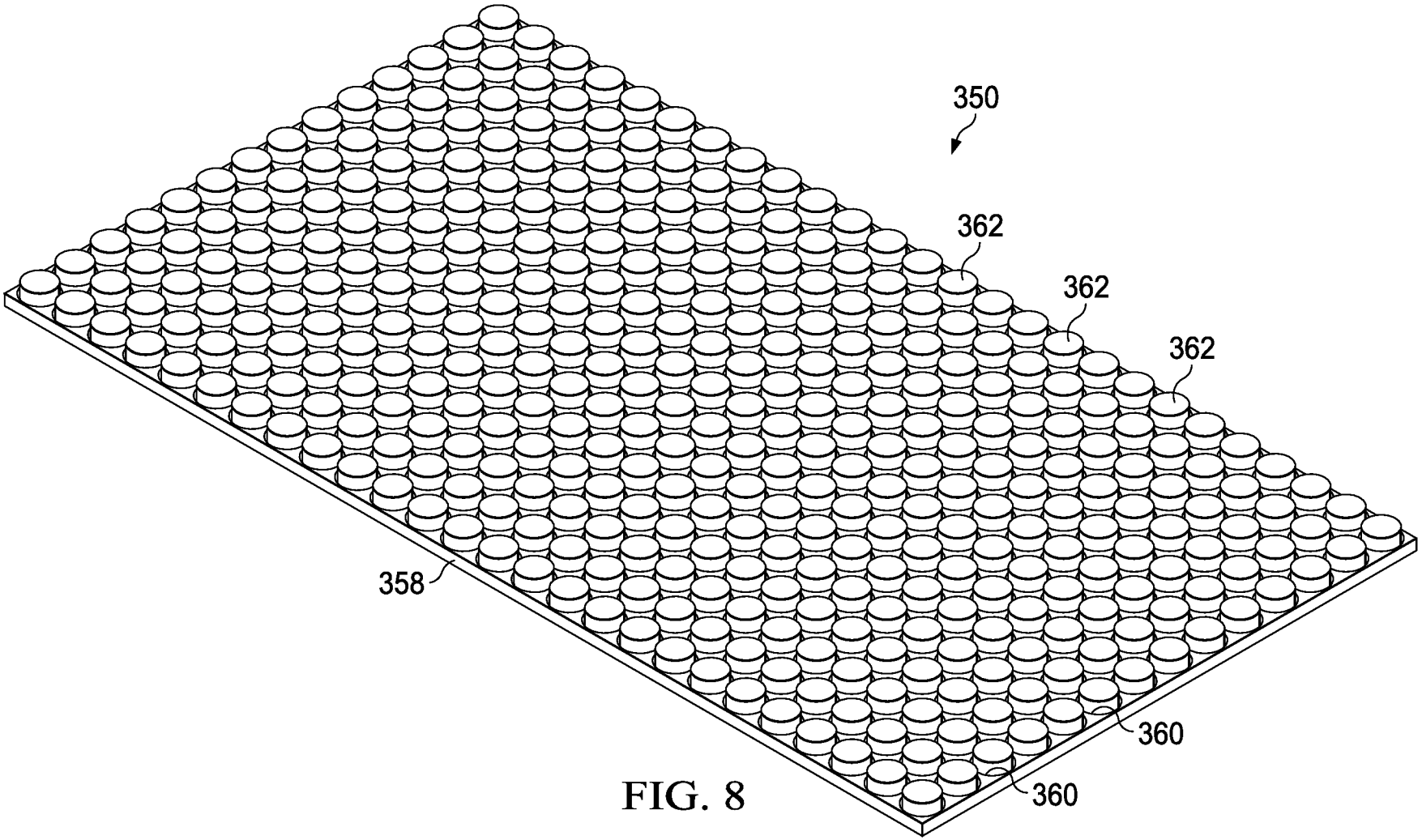
FIG. 8 is a front perspective view of a system of padding pockets having a top portion and a bottom portion, shown with the top portion removed to display the plurality of foam components nested therein, according to one embodiment.
Figure 9:
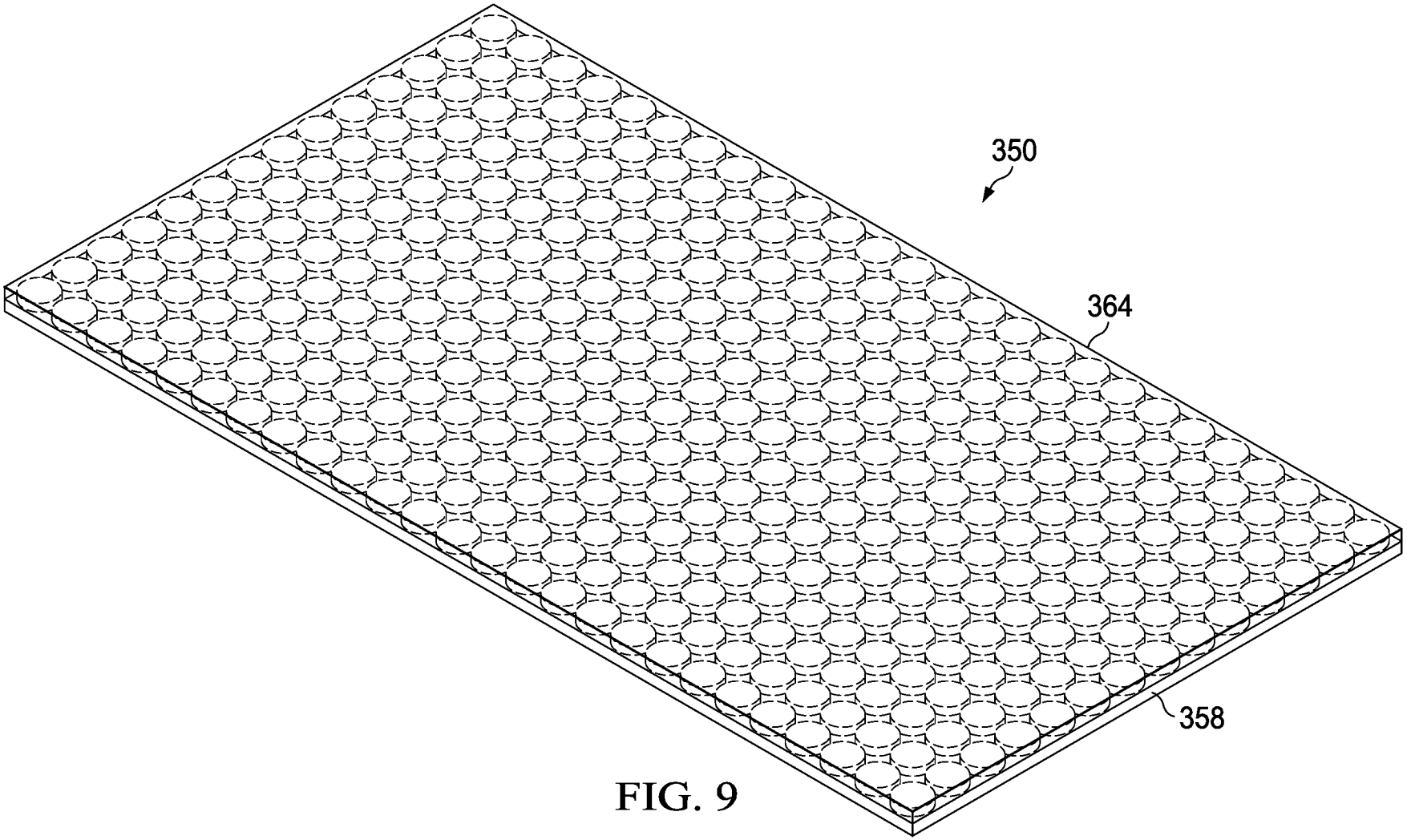
FIG. 9 is a front perspective view of the system of FIG. 10 shown with the top portion of the system placed over the nested foam components according to one embodiment.

FIG. 8 illustrates an alternate embodiment of a sheet 350 that can incorporate a plurality of padded components 334. The sheet 350 can include a substantially contiguous bottom layer 358 defining a plurality of apertures 360. In the illustrated example the apertures 360 can have a substantially cylindrical shape. The apertures 360 can be sized to accept a plurality of padded components 362 such that the padded components are seated within the apertures 360. Referring to FIG. 9, once the padded components 362 have been positioned in the apertures 360, a substantially contiguous top layer 364 can overlay the bottom layer 358. The top layer 364 and bottom layer 358 can be fused or welded, for example, such that the sheet 350 retains the padded components 362 between the two layers. Such a configuration may facilitate manufacturing as the bottom and top layers can be readily formed or molded and easily assembled. In one embodiment the bottom layer 358 and the top layer 364 have an identical configuration. In the illustrated embodiment, the bottom and top layers do not include air gaps, but it will be appreciated that the sheet 350 can include any suitable features such as air gaps as described herein.

Figure 10:
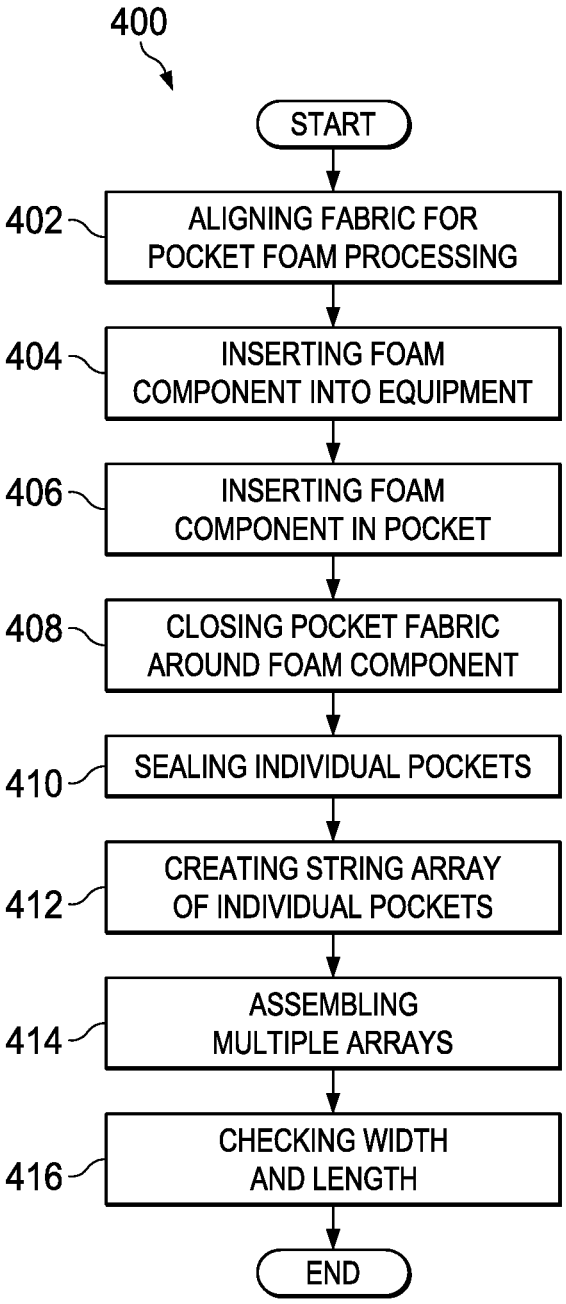
FIG. 10 is a flow chart depicting a process for creating a padding pocket system or assembly according to one embodiment.

Referring to FIG. 10, one embodiment of a method 400 is illustrated for creating a mattress, topper, or sheet, such as sheet 50, incorporating a plurality of padding components in a plurality of string arrays. Step 402 can including providing a suitable fabric having a defined pocket, such as pocket 32, and aligning the fabric material such that a padding component can be inserted. Step 404 can include providing a padding component, such as a padding component 34, and inserting the padding component into a "pusher" machine (not shown) for insertion into the pocket. Step 406 can include inserting the padding component into the pocket with the "pusher" machine. Step 408 can include closing the pocket around the padding component. Step 410 can include sealing the pocket to form, for example, a pocket assembly 30. Any suitable sealing, fastening, or welding process is contemplated. Step 412 can include joining a plurality of pocket assemblies to form a string array, such as a string array 40. Step 414 can include joining or assembling a plurality of string arrays to form a sheet such as, for example, sheet 50. Step 416 can include measuring the sheet to confirm that the width and length meet the desired specifications for the sheet.

Figure 11:
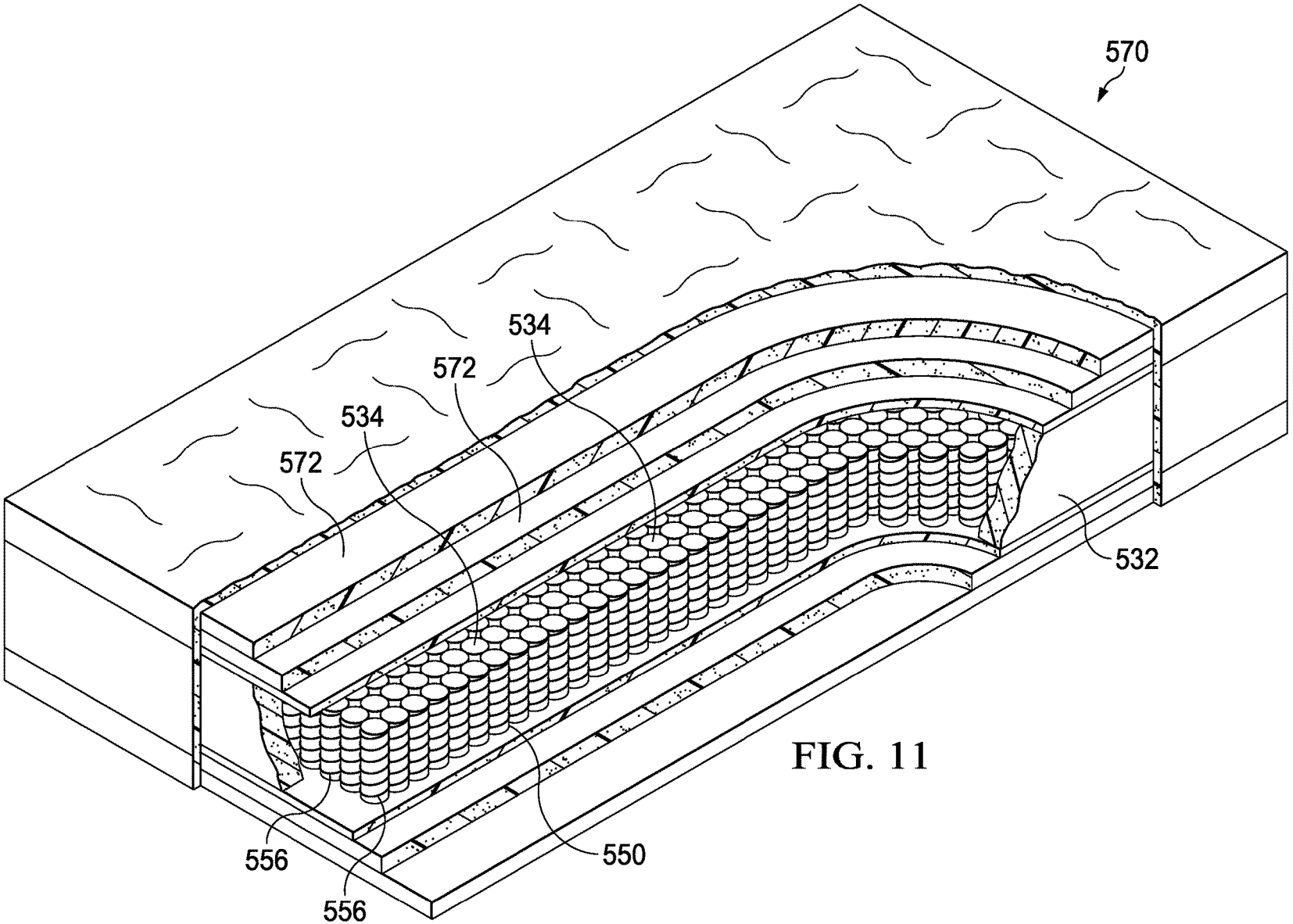
FIG. 11 is a front, perspective partial cutaway view of a mattress having a plurality of padding components wrapped with a plurality of coils.

Referring to FIG. 11, one version of a mattress 570 is illustrated that can incorporate a sheet 550 in accordance with versions described herein. The sheet 550 can be positioned between any suitable number of layers 572, which can include innerspring layers, an innerspring core, padding layers, pocketed coils, or the like associated with the mattress 570. The sheet 550 can include a plurality of padding components 534 that can have a substantially vertical orientation and can be constructed from foam or any other suitable material. Each of the padding components 534 can be positioned wholly or partially within a spring or coil 556. The plurality of padding components 534 and coils 556 can be encased partially or wholly within a pocket 532 such that the padding components are held in their desired position. Wrapping a coil 556 about a padding component 534 may provide the benefits of a foam system with the advantages associated with a coil system. It will be appreciated that the pocket 532 can encapsulate substantially all of the foam components, as illustrated in FIG. 11, or an individual pocket can be associated with each padding component and coil. It will be appreciated that substantially all of the padding components can be associated with a coil, selected padding components can be associated with a coil, and/or a variety of padding components and coils or springs can be provided.

In embodiments incorporating a padding component 534 and a spring 556 it will be appreciated that the padding component 534 can have the shape of a cylinder, hour glass, barrel, square, triangle, square, pentagon, hexagon, heptagon, octagon, nonagon, decagon, cube, cuboid, sphere, cone, hexagonal prism, pyramid base, dissimilar geometries, polygons, or the like. It will be appreciated that any suitable spring 556 is contemplated having any suitable configuration, position, and elasticity. In an alternate embodiment (not shown), a pocket within a sheet can include only a coil where, for example, no padding component is provided within the pocket and the coil is partially or wholly encapsulated by the pocket. In alternate embodiments, the spring can be embedded within the padding component, affixed to the outer surface of the padding component, or retained by the padding component with a friction fit.

Referring to FIGS. 12-15, embodiments described herein may be well suited for use as a topper or supportive layer for a mattress. A mattress topper can include a cushioned pad that sits on top of a mattress. The mattress topper can be distinctly different from a mattress core, where a mattress core can be encased in a lower layer of a finished mattress, or the mattress topper can be formed in the upper or top layer closer to the sleep surface. Mattress toppers can be used to improve the cushioning of a mattress. The mattress topper can be used to customize the comfort of a mattress where the cushioning can be managed by the foam grade, thickness, density and ILD, for example. Mattress toppers can be assembled into the design of a bed, but can also be purchased "over the counter" in retail stores.

Mattress toppers in accordance with versions described herein can be made with memory or viscoelastic foam, latex, or urethanes which can create a comfortable bedding surface. Such toppers can incorporate padded pockets, such as those described herein, having any suitable configuration.

Figure 12:
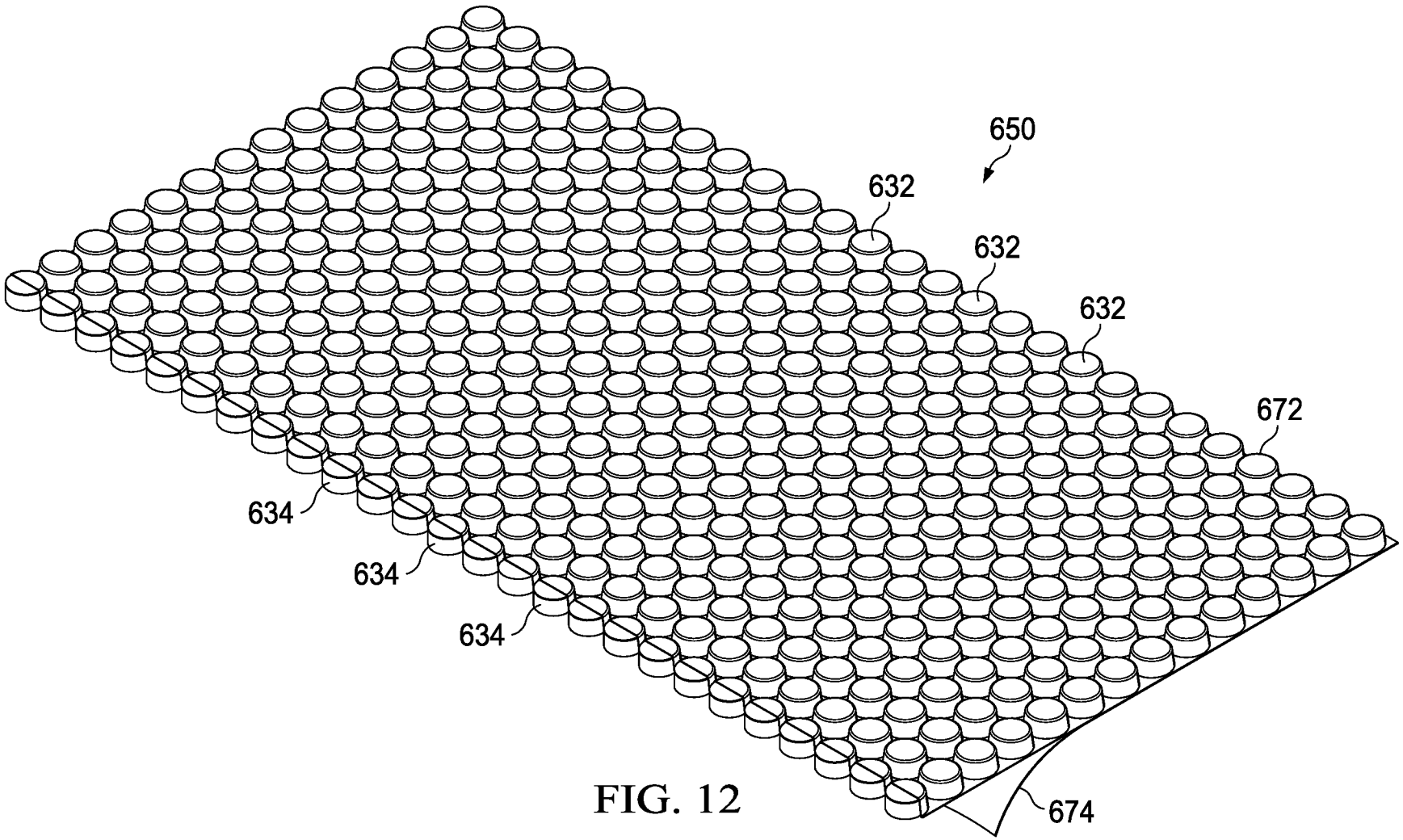
FIG. 12 is a front, perspective partial cutaway view of a topper having a pocket system according to on embodiment.

Referring to FIG. 12, one embodiment of a topper 650 is illustrated. The topper 650 can include a first pocket section 672 and a second pocket section 674 that can cooperate to encase a plurality of padding components 634. The first pocket section 672 can be a substantially contiguous sheet of material that can be formed with a plurality of pockets 632 that can be sized to accept the padding components. In the illustrated embodiment the pockets 632 can be substantially cylindrical in shape and can be shaped and sized to accept padding components 634 have a corresponding cylindrical shape. The padding components 634 can be positioned within the pockets 632 of the first pocket section 672 and can be retained with an adhesive, seal, weld, or can be seated within the pockets 632 without an attachment feature. The second pocket section 674 can be substantially planar and can be combined with the first pocket section 672 to retain the padding components 634 within the pockets 632. The first pocket section 672 and the second pocket section 674 can be sealed, welded, fused, sewn, or the like to form the topper 650. Example configurations of the topper 650 can have a pocket 632 height of from about 0.25 inches to about 4 inches, from about 1 inch to about three inches, from about 2 inches to about 5 inches, or any suitable combination thereof. It will be appreciated that the pockets associated with the topper can vary in size and shape to create, for example, ergonomic configurations.

The topper 650 can include padding components 634 constructed from any suitable material such as polyurethane foam, polyethylene foam, polyether foam, viscoelastic memory foam, polyester fibers, gel foam, latex foam, other chemistry based technologies, or combinations thereof. Individual pockets can include any suitable foam components having any suitable shape such as cylinder, hour glass, barrel, square, triangle, square, pentagon, hexagon, heptagon, octagon, nonagon, decagon, cube, cuboid, sphere, cone, hexagonal prism, pyramid base, dissimilar geometries, or combinations thereof. It will be appreciated that a topper can have a similar configuration to the pocket associated with an underling mattress having a padded pocket system. The topper can be integral with a mattress core, removable from a mattress core, or purchased off the shelf as an independent component. In one embodiment, a mattress can be configured to accept a particular topper for engagement, where a fastening or latching mechanism (not shown) can be associated with the mattress core. The mattress can be configured to accept one or more different toppers where, for example, two users of a single bed may elect to have one topper on one side of the bed and a different topper on the other side of the bed. It is also contemplated that the pockets can be adjustable, such as with air pressure or temperature, to change the sleep conditions. It is also contemplated that the topper or mattress can normalize or adjust to a pre-programmed user condition, such as a desired temperature, automatically.

Figure 13:
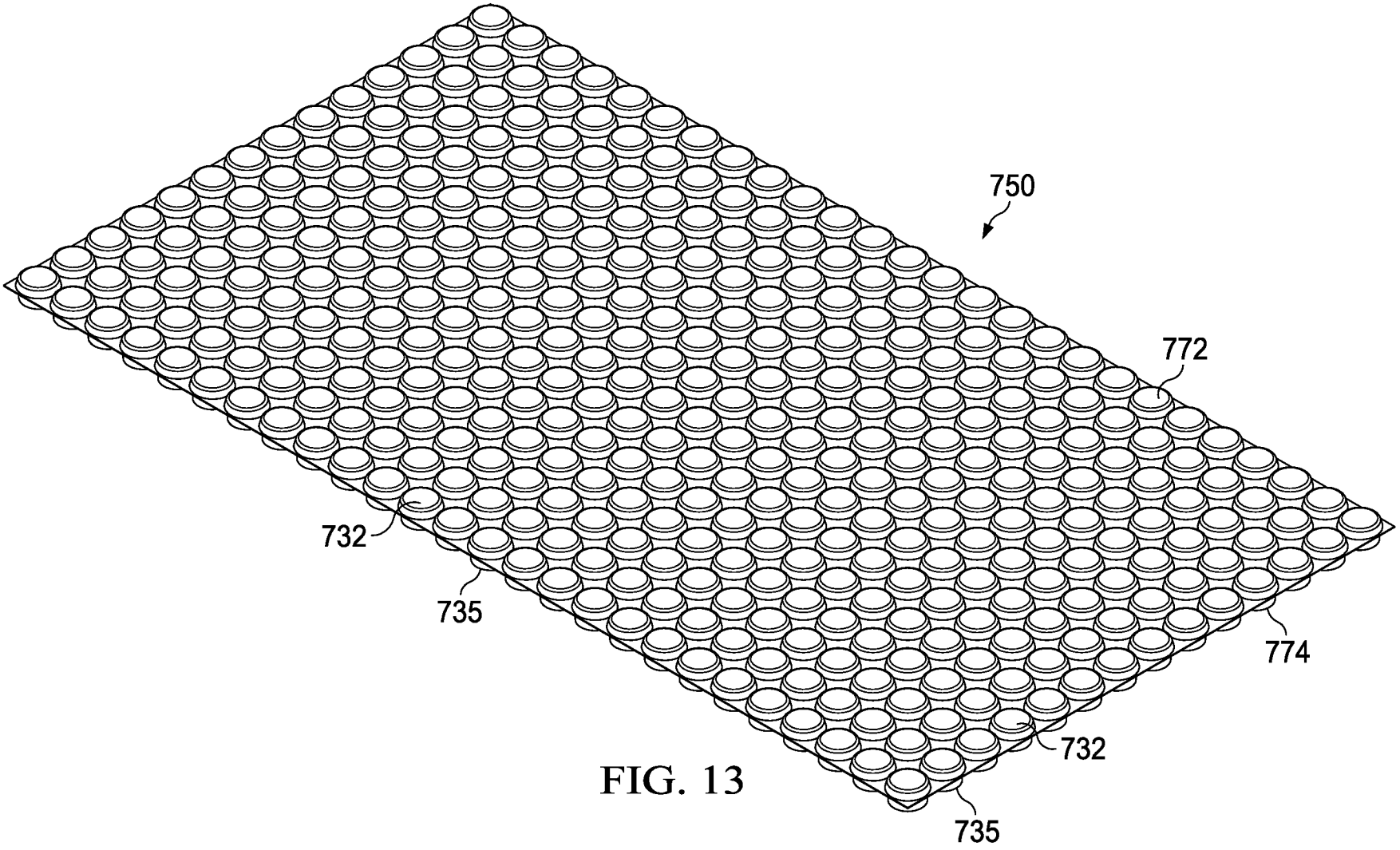
FIG. 13 is a front, perspective partial cutaway view of a topper having a pocket system according to an alternate embodiment.
Figure 14:
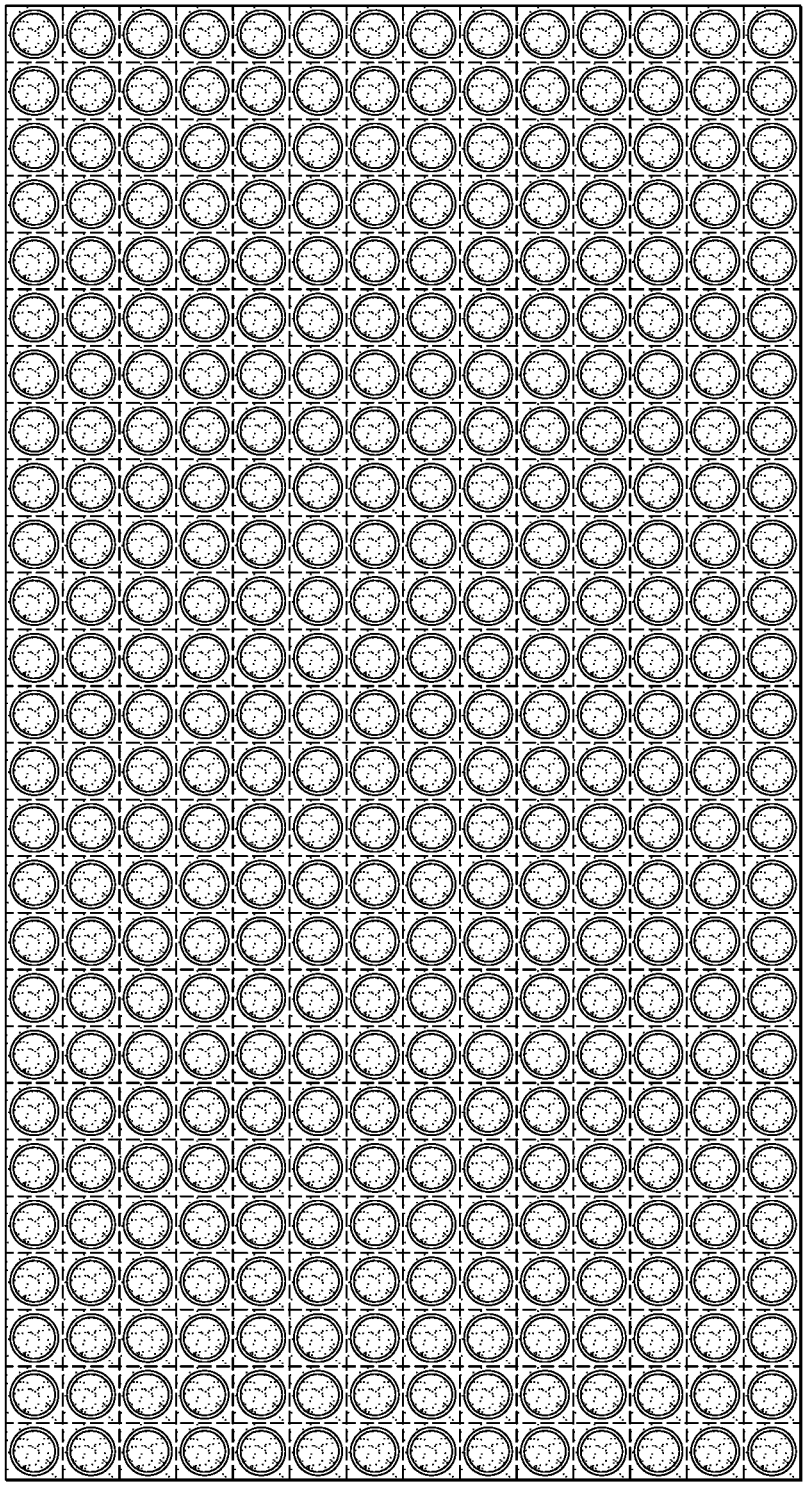
FIG. 14 is a top view of a topper having a pocket system according to one embodiment.

Referring to FIGS. 13 and 14, an alternate embodiment of a topper 750 is illustrated having a first pocket section 772 and a second pocket section 774 that can cooperate to encase a plurality of padding components (not shown). The first pocket section 772 can be a substantially contiguous sheet of material that can be formed with a plurality of pockets 732 that can be sized to partially accept the padding components. The padding components can be positioned partially within the pockets 732 of the first pocket section 772 and can be retained with an adhesive, seal, weld, or can be seated within the pockets 732 without an attachment feature. The second pocket section 774 can be substantially identical to the first pocket section 772 and can include pockets 735 that correspond to and cooperate with the pockets 732 to retain the padding components. The first pocket section 772 and the second pocket section 774 can be sealed, welded, fused, sewn, or the like to form the topper 750.

It will be appreciated that any suitable layer or section of material can retain any suitable component in any suitable fashion to form a topper, mattress, bedding, pad, or the like. In one version, each pocket can have a slot into which a component, such as a foam padding component, is inserted to complete the topper, where different types of components can be used with the same sheet of pocketed material such that a substantially universal pocket layer is created. The topper can be divided in sections using welds, where each section can have a single pocket and foam component as illustrated more clearly in FIG. 14, where such welds or sections may increase the strength of the topper.

Figure 15:
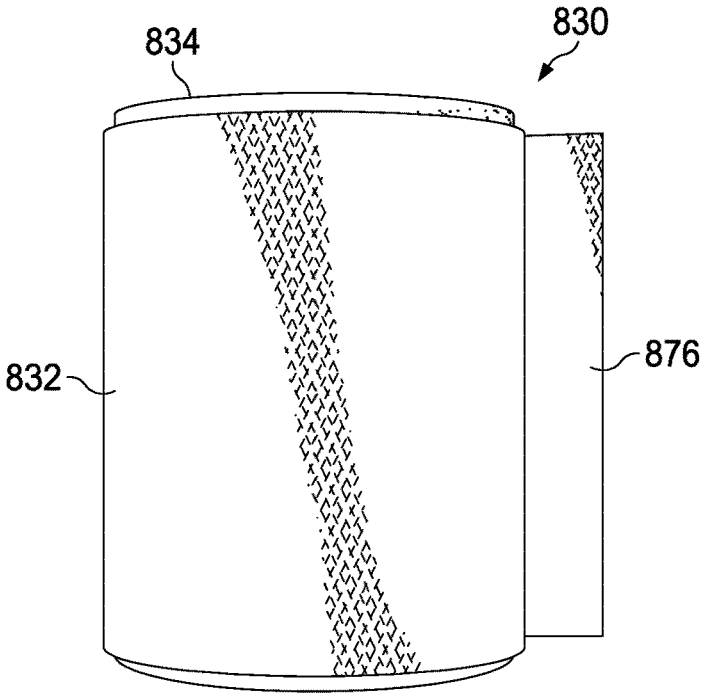
FIG. 15 is a front view of a foam component wrapped in a material according to one embodiment.
Figure 16:
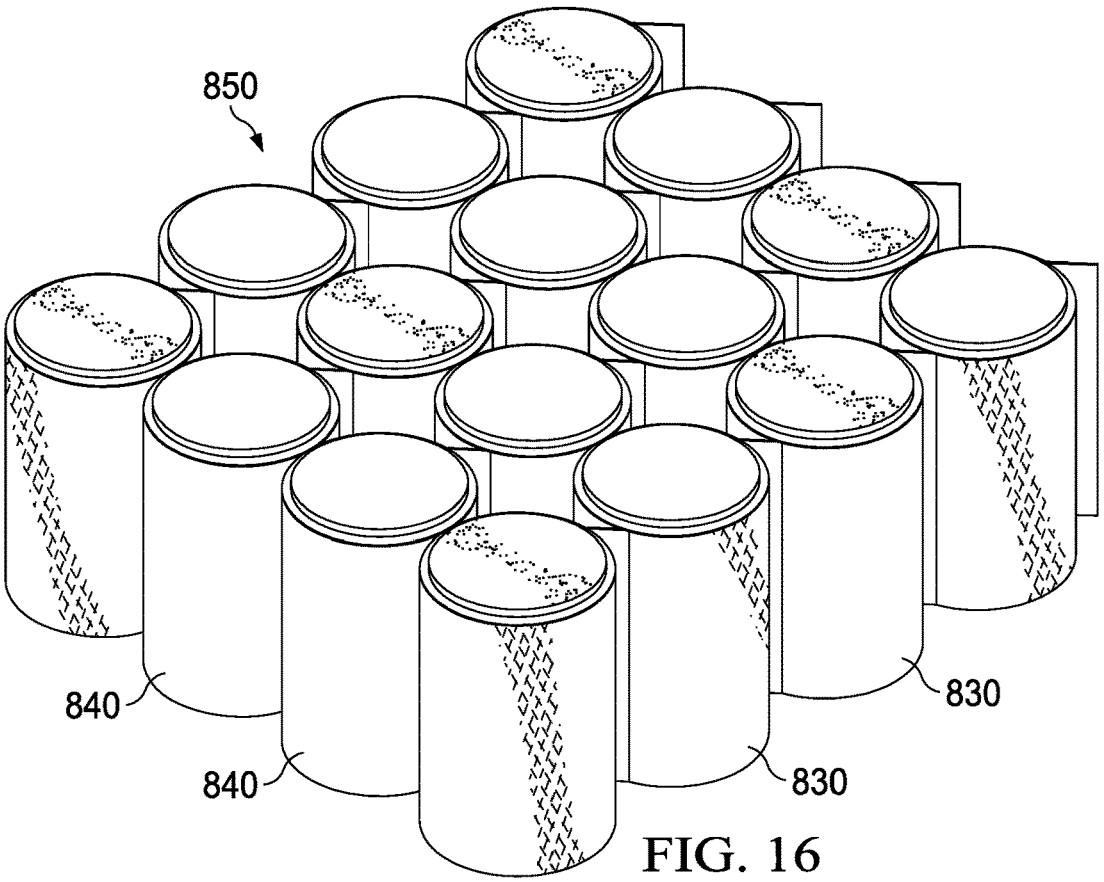
FIG. 16 is a perspective view of a plurality of padding components wrapped in material according to one embodiment.

Referring to FIG. 15, one embodiment of a padding assembly 830 that can be used with a mattress or topper is illustrated. The padding assembly 830 can be formed in accordance with the systems and methods described with reference to FIG. 18. The padding assembly 830 can include a foam component 834 and a wrapping 832 that can surround substantially the circumference of one or a plurality of the foam components 834. The wrapping 832 can be a single sheet of material that can be sized and folded to substantially surround the foam components 834. After each successive padding component 834 is wrapped a weld section 876 extending laterally and comprising the two ply folded material of the wrapping 832 can be fused to secure the padding component 834 and the wrapping 832. The weld 876 can be fused, welded, adhered, or sewn such that the padding component 834 is retained by the wrapping 832. Successive foam components 834 can be secured by the wrapping 832 and welds 876 to form a string assembly 840 as illustrated in FIG. 16. As shown in FIG. 16, a plurality of string assemblies 840 can be combined into a sheet 850.

Figure 17:
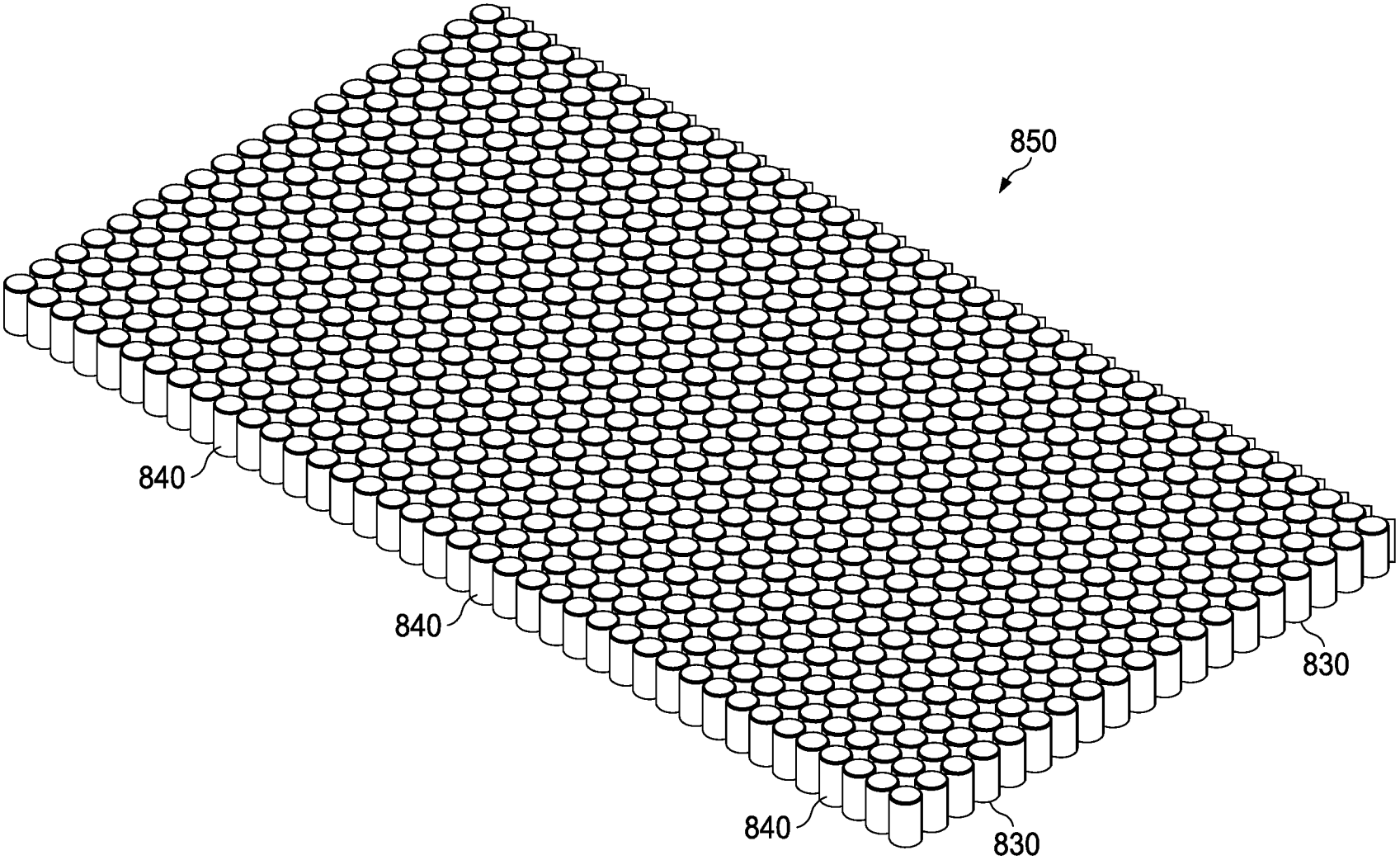
FIG. 17 is a perspective view of a sheet constructed with a plurality of padding components attached with a material wrap according to one embodiment.
Figure 18:
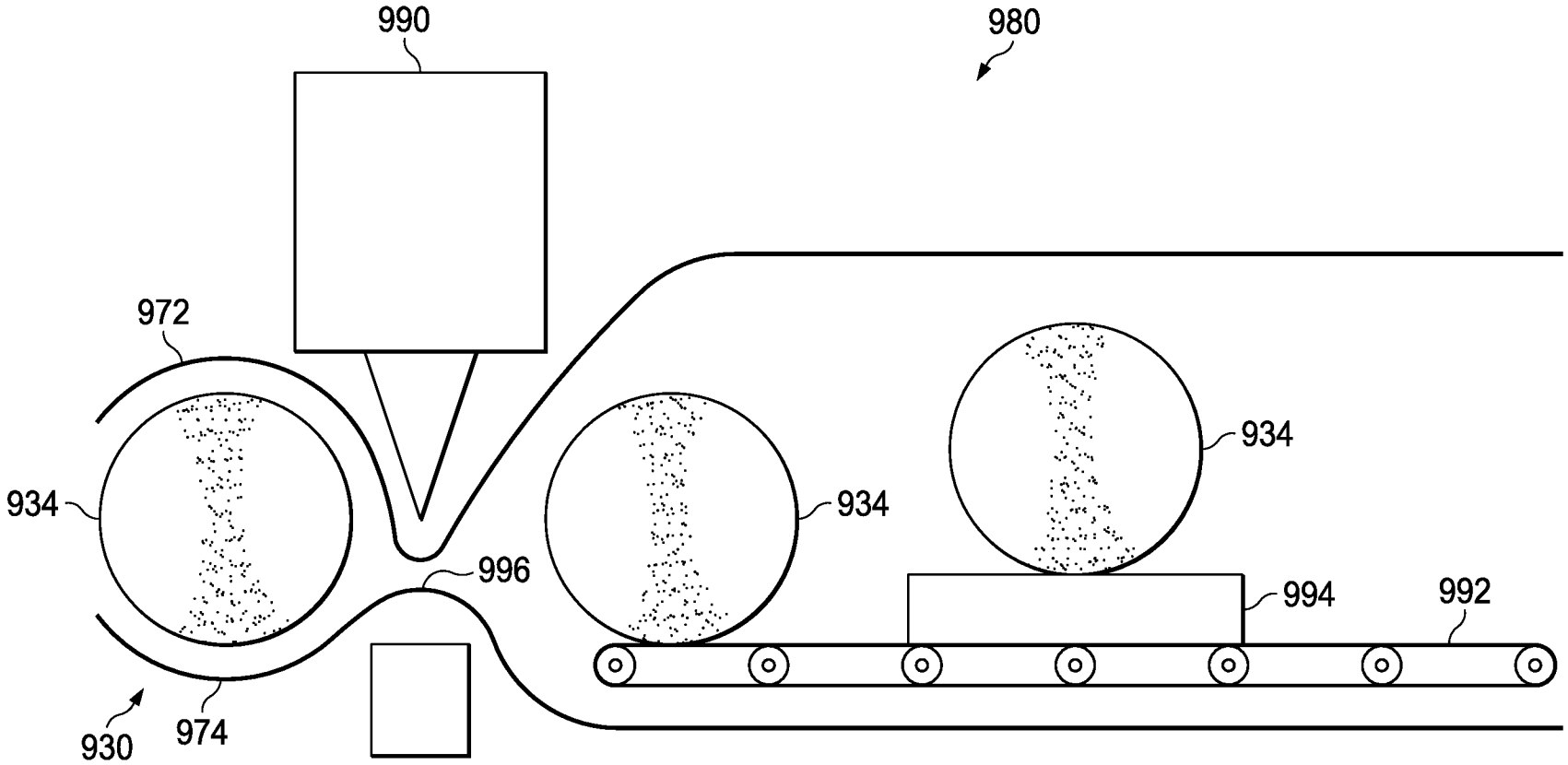
FIG. 18 is a schematic view of a process for attaching padding components using a material welder according to one embodiment.

With reference to FIG. 18, one embodiment of a pocket coil system 980 is shown that can be used in a wrapped mode and a two-ply mode to form a plurality of pocket assemblies 930. The wrapped mode (not shown) can use a single piece of material, such as wrapping 832 described with reference to FIGS. 15-17, to form a string array by folding a single piece of material over a plurality of padding component and fusing the material in a series of weld. The two-ply mode, as shown in FIG. 18, can incorporate a first layer 972 and a second layer 974 that can be fused with a welder 990 to substantially encapsulate or wrap a padding component 934 by forming a plurality of welds 996. The two-ply mode can be used to form welds 996 on opposite sides of the padding component 934 in a substantially horizontal plane.

The two-ply mode may be advantageous where a pocket coil system 980 can be used to create string arrays having a variable number of pocket assemblies 930 without having to define a specific amount of material in advance. For example, the first layer 972 and the second layer 974 of material can be fed into the pocket coil system 980, which can be preprogrammed to terminate a string array when a specified number of pocket assemblies 930 have been formed. The pocket coil system can include a cutter (not shown) that can cut the layers 972, 974 when the desired string array size has been formed. In this manner, the same pocket coil system 980 can form different sized string arrays from the same feed of the layers 972, 974 by cutting or otherwise severing the material when the desired length is achieved. It will be appreciated that the pocket coil system 980 can include a controller or programmable computer that can allow for pre-set configurations for the development of string arrays, sheets, or the like.

Still referring to FIG. 18, a plurality of padding components 934 can be fed through the welder 990, such as along a conveyor 992, such that a string array of wrapped padding components is formed. The padding component 934 can enter the conveyor 992 on a carrier 994, where the carrier 994 can align the padding component 934 as it travels down the conveyor 992. The energy used by the welder 990 to weld the first layer 972 and the second layer 974 can be radio frequency, sonic, or heat, for example. The welder 990 can form welds 996 on each side of the padding component 934 to substantially wrap the padding component 934 in a straight-line diameter. It will be appreciated that any suitable component, feature, or mechanism can be incorporate into the pocket coil system 980. The pocket coil system 980 can be used with any padding components, foam components, or other bedding features for example. The wrapping material can be any suitable fabric and have any suitable shape or configuration. The pocket coil system 980 can be configured to provide a variable number and type of pocket assembly, string array, or the like. For example, a single pocket coil system 980 can be used to create a mattress, topper, or the like that has a first string array having a first type of padding component, a second string array having a second type of padding components, etc., where each successive string array is formed and then aligned automatically or manually into a mattress, topper, sheet, or the like. In this manner a single coil system 980 can be used to form a mattress or topper having different types of pocket assemblies.

Embodiments having a wrapped configuration, such as the embodiment shown in FIG. 15, can have a portion of the padding or foam component exposed and not fully encapsulated in fabric. In such examples, a top portion and a bottom portion of the foam component can be exposed. Such a configuration may facilitate breathability and comfort as the user can be positioned directly on the padding component. The exposed area of the padding component can be, for example, from about 0.1 inches to about 0.25 inches from the top or bottom of the component, from about 0.2 inches to about 1 inch, from about 0.1 inches to about 0.5 inches, or any other suitable distance. The foam exposure may promote an even sleep surface. In an alternate embodiment the wrapping material can extend substantially to the top and/or bottom surface of the padding or foam component and/or above the top and bottom surface.

Figure 19:
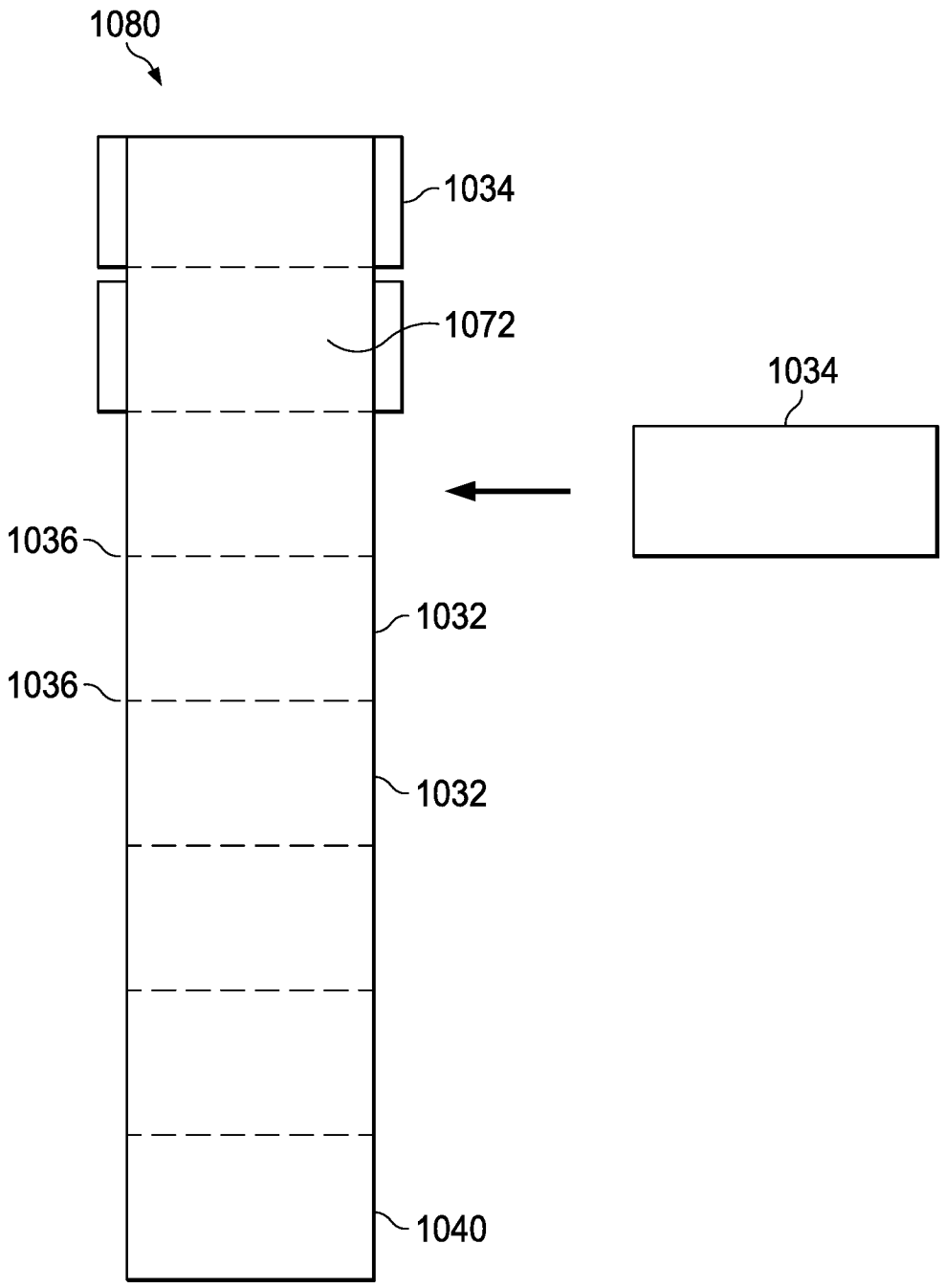
FIG. 19 is a side view of an alternate padding system for providing wrapped padding components, where multiple padding components are shown inserted into pockets of the padding system according to one embodiment.

Referring to FIG. 19, an alternate embodiment of a wrapping system 1080 is shown. The wrapping system can include a string array 1040 having a plurality of pockets 1032 that can be defined in the string array 1040 by a plurality of welds 1036. The string array can be two ply such that each pocket 1032 has a first layer of material 1072 that is coupled to a second layer (not shown) with the welds 1036. The pockets 1032 can be any suitable size, but in the illustrated embodiment can be sized to accept a plurality of foam padding components 1034. The padding components 1034 can be inserted into the pockets 1032 mechanically, manually, or by any suitable mechanism. In the illustrated example, a plurality of string arrays 1040 can be prepared and the padding components 1034 can then be inserted for final assembly. The padding components 1034 can be glued into the pockets 1032, retained with a friction fit, retained with an adhesive, retained with a mechanical fastener, or can be selectively removable from the pockets 1032. It may be beneficial to provide a system that can generate a string of pockets that can later be filled or provided with padding components. For example, if a variety of padding components having different properties, such as density properties, can be associated with the same pocket array then the pocket array can be mass produced and appropriate padding components can later be introduced based upon need.

Figure 20:
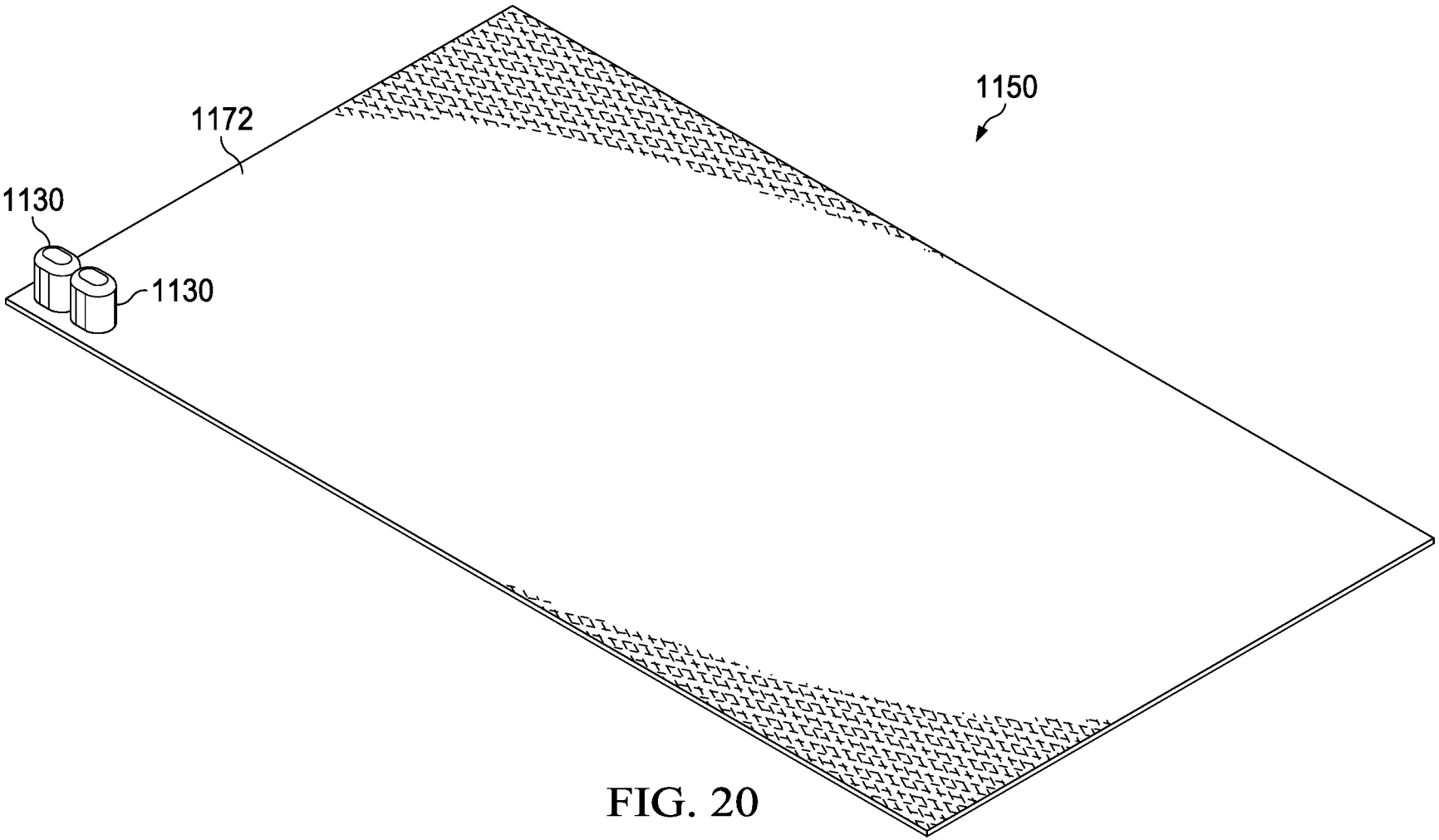
FIG. 20 is a perspective partial view of a padding system incorporating a plurality of individual padding pockets according to one embodiment.

Referring to FIG. 20, a partial view of an alternate version of a padding system 1150 is shown. The padding system 1150 can be a closed foam system that can include a plurality of individually encapsulated or closed padding pockets 1130. Each of the closed padding pockets 1130 can include foam, a padding component, a spring, a coil, or the padding pockets 1130 can be constructed entirely from a single material such that a separate pocket is not provided. The individual padding pockets 1130 can allow a user to select a bedding configuration that is ideally suited to their needs by combining desirable types of padding pockets 1130, other layers, or material, in any suitable arrangement or configuration. For example, during assembly of a mattress or topper a customer may select a particular type of padding pocket 1130 that can have desirable traits such as stiffness, rate of return, breathability, temperature, or the like that are appealing to the user. The selected padding pockets 1130 can be coupled with a first layer 1172 of substrate to begin forming a mattress, topper, or the like. In one embodiment, the process can include lamination of each of the padding pockets 1130 to the first layer 1172 of the substrate. The first layer 1172 of the substrate can include woven or non-woven material, films, polyesters, nylon, cotton, UBL or any suitable fabric materials. The individual padding pockets 1130 can be adhered to a substrate or fabric to maintain position in the padding system 1150. Each individual pocket can be positioned and laminated to the substrate in accordance with the design of the overall mattress, topper, or the like. Upon placement of all of the padding pockets 1130, in one embodiment, a second layer (not shown) of material can be provided over the padding pockets 1130 to create a substantially closed layer. In this manner a couple using the same bed, for example, can select different types of padding pockets 1130 for their portion of the bed that meet their specific needs.

Figure 21:
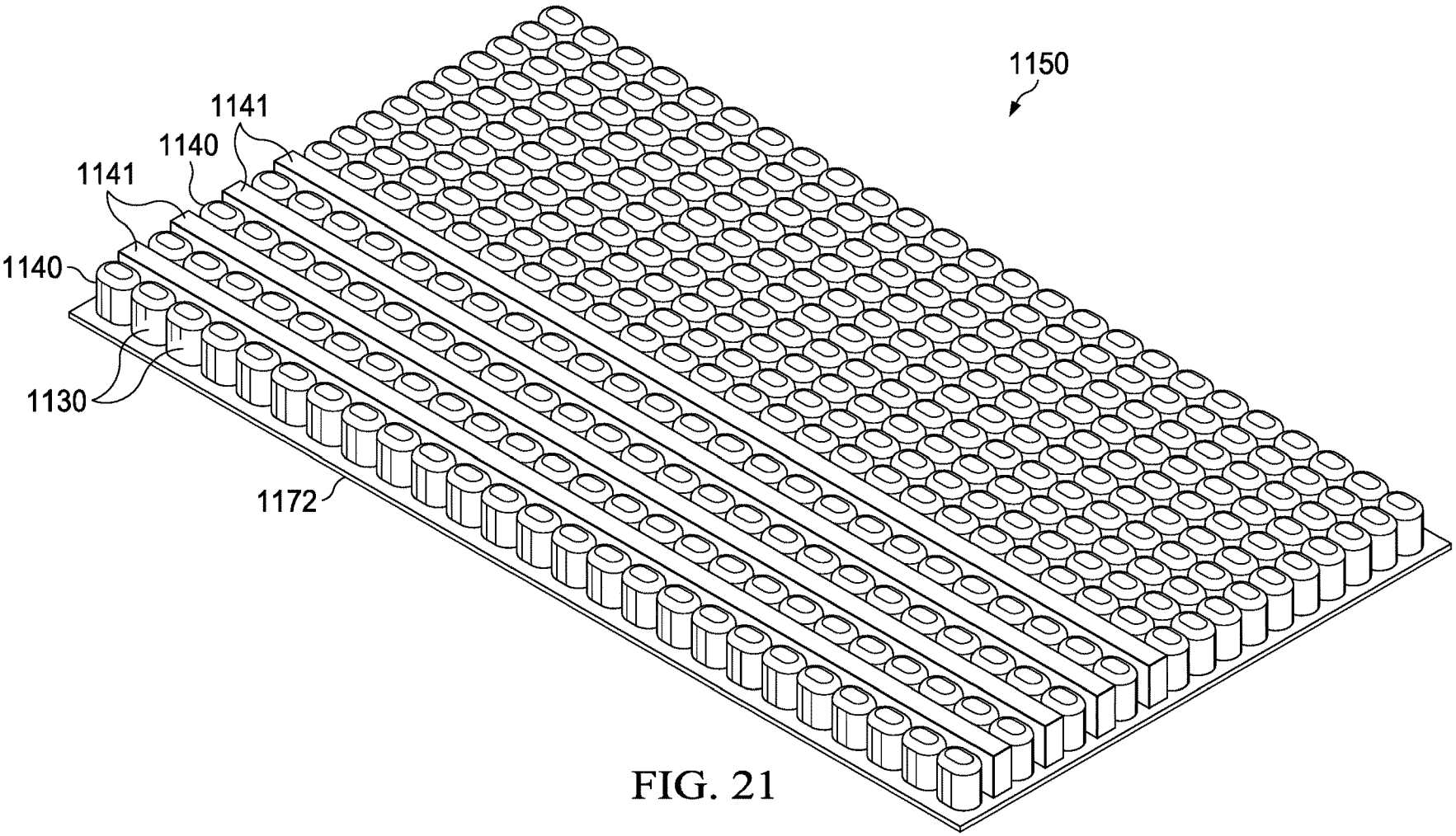
FIG. 21 is a perspective partial view of a padding system incorporating rows of padding pockets and rows of foam padding according to one embodiment.
Figure 22:
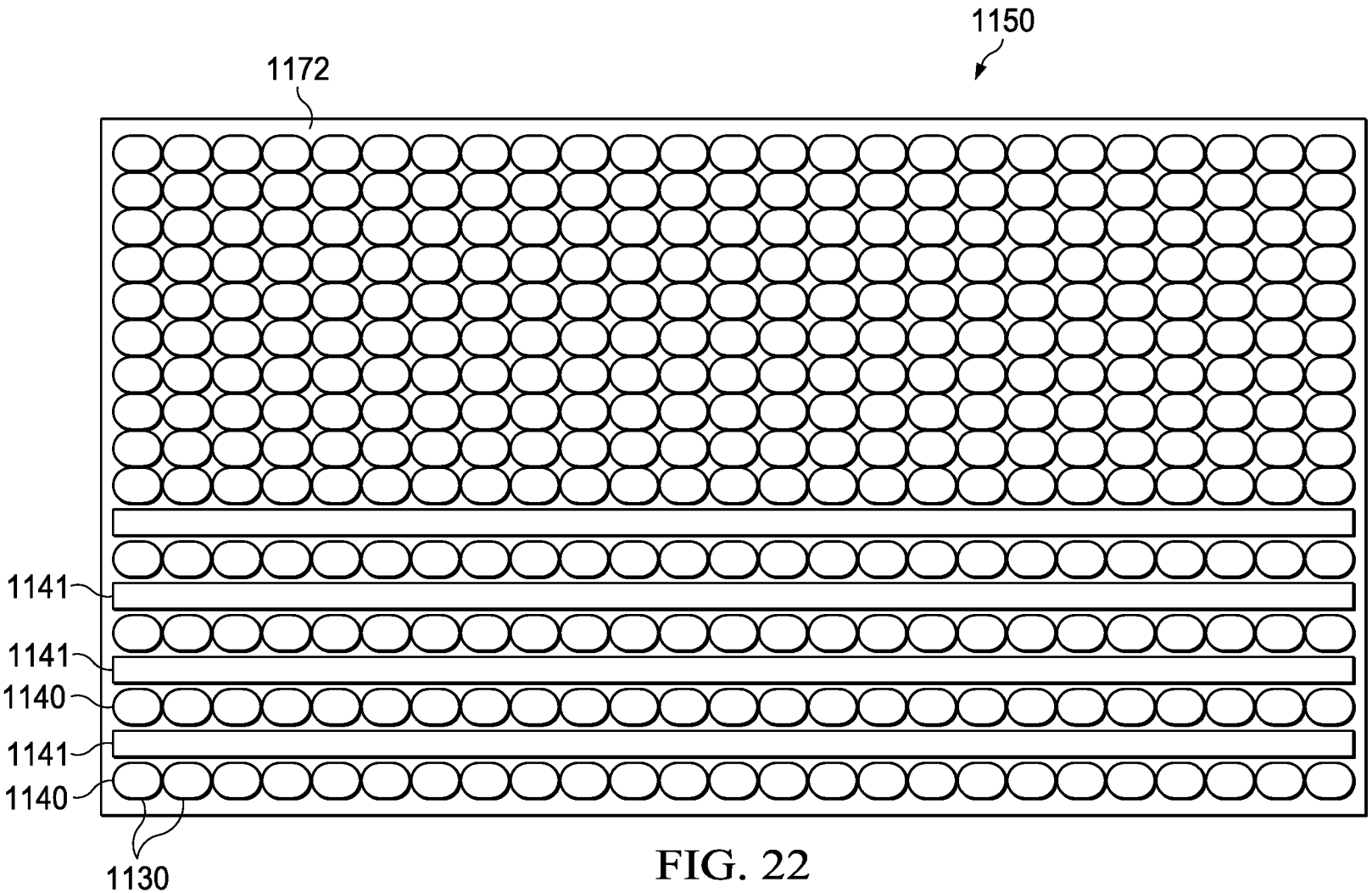
FIG. 22 is a top view of the padding system of FIG. 21.

Referring to FIGS. 21 and 22, a version of the padding system 1150 is shown where the padding pockets 1130 can be formed into a plurality of first rows 1140. The rows 1140 can including any suitable number and type of padding pockets 1130 and can be attached to the first layer 1172 of the substrate in any suitable matter. The padding system 1150 can include a plurality of second rows 1141 that can differ from the plurality of first rows 1140. For example, the second rows 1141 can include a single uninterrupted portion of foam, which can include polyurethane, polyester, polyether, viscoelastic memory foam, fibers, gel, latex, and other chemistry based foams. It will be appreciated that the rows can include foam, innersprings, pocket innersprings, padding pockets 1130 having variable construction, or any other suitable arrangement. It will be appreciated that rows are disclosed by way of example only, where different configurations are contemplated such that different properties are imparted to different regions of the padding system 1150. In one embodiment, the padding pockets or other components can be removable or replaceable from the padding system 1150 such that changes can be made over time based upon user preference.

Example embodiments described herein can include any suitable feature, component, device, or mechanism wholly or partially retained within a pocket, pod, enclosure, capsule, or the like. For example, coil springs can be used with a pocket system for cushioning support for bedding and furniture applications. The coil spring process can include connecting coils in an array of wire that can be connected through helical lacing. Coil springs can be joined together by assembly through a lacer, which can combine coil through wires or fabric. The coil assemblies can be placed in a plurality of pockets in a mattress as a core. The core spring assembly can be sandwiched between foams that can include urethane, viscoelastic, or latex foam material, for example. The foam can help with cushioning support and can protect the sleep surface from being penetrated by coil springs. Systems can include foam cores that can include materials of viscoelastic, urethane, or latex foam. In such applications, foam may not be needed where the foam core provides cushioning without abrasion to the outer layer. It will be appreciated that one or a plurality of padding pockets can be used with any suitable core or other system of layered materials. It will be appreciated that a plurality of different layers of padding pockets can be joined or layered to form a mattress or other pad. It will be appreciated that the layers in such a system may have uniform or different types of padding pockets. In one embodiment, a user can select from a variety of core, layer, and/or padding pocket options to obtain the desired characteristics of softness, comfort, rigidity, heat retention, durability, stiffness, elasticity, memory retention, or the like.

In various embodiments disclosed herein, a single component can be replaced by multiple components and multiple components can be replaced by a single component to perform a given function or functions. Except where such substitution would not be operative, such substitution is within the intended scope of the embodiments.

Some of the figures can include a flow diagram. Although such figures can include a particular logic flow, it can be appreciated that the logic flow merely provides an exemplary implementation of the general functionality. Further, the logic flow does not necessarily have to be executed in the order presented unless otherwise indicated. In addition, the logic flow can be implemented by a hardware element, a software element executed by a computer, a firmware element embedded in hardware, or any combination thereof.

The foregoing description of embodiments and examples has been presented for purposes of illustration and description. It is not intended to be exhaustive or limiting to the forms described. It will be appreciated that systems and embodiments described herein can be applied to mattresses, mattress cores, toppers, supportive layers, and any layer associated with bedding, bedding materials, padding, padding materials, or the like. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A padding system comprising:

(i) a first pocket assembly, the first pocket assembly including;

1. a first pocket, wherein the first pocket has a top and a bottom and defines a first cavity having a first volume; and
2. a first foam component, the first foam component wholly filling the first volume of the first pocket such that the first foam component projects outwardly from and is not enclosed by at least one of the bottom or the top of the first pocket;

(ii) a second pocket assembly, the second pocket assembly including;

1. a second pocket, wherein the second pocket has a top and a bottom and defines a second cavity having a second volume; and
2. a second foam component, the second foam component wholly filling the second volume of the second pocket such that the second foam component projects outwardly from and is not enclosed by at least one of the bottom or the top of the second pocket; and (iii) a bedding substrate;

(iv) a first transition portion attaching the first pocket assembly to the bedding substrate; and (v) a second transition portion attaching the first pocket assembly to the second pocket assembly and wherein the first pocket assembly and the second pocket assembly form a string array.

2. The padding system of claim 1, wherein the first padding component and the second padding component are constructed from different materials.

3. The padding system of claim 1, wherein the first padding component has a first section with a first set of properties and a second section with a second set of properties, wherein the first set of properties are different from the second set of properties.

4. The padding system of claim 3, wherein the first section is a first material and the second section is a second material, wherein the first material is different from the second material.

5. The padding system of claim 3, wherein the first section has a first density and the second section has a second density, wherein the first density is different from the second density.

6. The padding system of claim 3, wherein the first section and the second section are constructed from the same type of material.

7. The padding system of claim 1, wherein the first transition portion defines a plurality of apertures, the plurality of apertures being attachment points between the first pocket assembly and the bedding substrate.

8. The padding system of claim 1, wherein the first transition portion is a weld.

9. The padding system of claim 1, wherein the first pocket and the second pocket are constructed from a single piece of the material such that the single piece of the material is folded and fused at spaced apart welds to form the first pocket and the second pocket.

10. The padding system of claim 1, wherein the first pocket and the second pocket are constructed from a first ply and a second ply of the material, where the first ply and the second ply are fused at spaced apart welds to form the first pocket and the second pocket.

11. The padding system of claim 10, wherein the spaced apart welds are formed with a pocket coil system.

12. The padding system of claim 1, wherein the first pocket and the second pocket each comprise a porous material.

13. The padding system of claim 1, wherein the first pocket and the second pocket each comprise a material selected from the group consisting of polypropylene, cotton, nylon, lycra, UBL, and polyester.

14. The padding system of claim 1, wherein the first pocket has a height dimension and a width dimension, and the ratio of the height dimension to the width dimension is 2:1.

15. The padding system of claim 1, wherein the first foam component is selected from the group consisting of polyurethane foam, polyethylene foam, polyether foam, viscoelastic memory foam, gel foam, latex foam, and combinations thereof.

16. The padding system of claim 1, wherein the padding system is a mattress topper.

17. The padding system of claim 1, wherein the first foam component has a density of between about 0.01 pounds per cubic foot to about 15 pounds per cubic foot.

18. The padding system of claim 1, wherein the padding system comprises a plurality of string arrays forming a substantially rectangular sheet.

19. The padding system of claim 18, wherein the plurality of string arrays comprises a plurality of pockets, and the plurality of pockets is adhered to a layer of material.

20. The padding system of claim 1, wherein at least one of the first foam component or the second foam component has a shape of a cylinder, an hour glass, a barrel, a cuboid, a sphere, a cone, a hexagonal prism, or a pyramid.

* * * * *